US007177582B2

(12) United States Patent
Ohta et al.

(10) Patent No.: US 7,177,582 B2
(45) Date of Patent: Feb. 13, 2007

(54) IMAGE FORMING APPARATUS USING ELECTROPHOTOGRAPHY AND PROCESS CARTRIDGE

(75) Inventors: Naoki Ohta, Minamiashigara (JP); Satoshi Shigezaki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/192,130

(22) Filed: Jul. 29, 2005

(65) Prior Publication Data

US 2006/0024100 A1 Feb. 2, 2006

Related U.S. Application Data

(63) Continuation-in-part of application No. 10/942,957, filed on Sep. 17, 2004.

(30) Foreign Application Priority Data

Mar. 24, 2004 (JP) ..... 2004-88112
Mar. 18, 2005 (JP) ..... 2005-080599

(51) Int. Cl.
*G03G 21/10* (2006.01)

(52) U.S. Cl. ..... 399/350; 399/102; 399/358

(58) Field of Classification Search ..... 399/350, 399/343, 358, 123, 102
See application file for complete search history.

(56) References Cited

U.S. PATENT DOCUMENTS 5,383,011 A * 1/1995 Numagami et al. ..... 399/358
2003/0152407 A1* 8/2003 Hatano ..... 399/350

FOREIGN PATENT DOCUMENTS

| | | | |
|---|---|---|---|
| JP | 05-127577 A | * | 5/1993 |
| JP | A 7-306616 | | 11/1995 |
| JP | A 8-27227 | | 1/1996 |
| JP | A 8-190252 | | 7/1996 |
| JP | A 8-194364 | | 7/1996 |
| JP | A 9-258632 | | 10/1997 |
| JP | A 11-24522 | | 1/1999 |
| JP | A 11-161125 | | 6/1999 |

* cited by examiner

*Primary Examiner*—Sophia S. Chen
(74) *Attorney, Agent, or Firm*—Oliff & Berridge, PLC

(57) ABSTRACT

An image forming apparatus including a toner accumulating member disposed nearer to the housing than the cleaning blade and the lower seal are, wherein the toner accumulating member accumulates the toner at a tip of the cleaning blade, the toner accumulating member has at least one opening, and the following condition is satisfied: $0\% < S(O)/S(C) \leqq 50\%$, wherein S(O) is a total opening area obtained by summing areas of all openings, and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

14 Claims, 6 Drawing Sheets

IMAGE FORMING APPARATUS USING ELECTROPHOTOGRAPHY AND PROCESS CARTRIDGE

CROSS-REFERENCE TO RELATED APPLICATION

This application is a continuation-in-part of application Ser. No. 10/942,957, filed on Sep. 17, 2004. This application claims priority under 35 USC 119 from Japanese patent Application Nos. 2004-88112 and 2005-80599, the disclosures of which are incorporated by reference herein.

BACKGROUND OF THE INVENTION

1. Field of the Invention

The present invention relates to an image forming apparatus using an electrophotography method and a process cartridge used for the apparatus.

2. Description of the Related Art

In a conventional electrophotographic method, a coloring toner is developed to an electrostatic latent image manufactured by charging the surface of an image carrier and exposing the surface to produce a visible image, and the toner image is transferred onto a transfer paper or the like. Then the toner image is fixed by a heat roll or the like to form the image. Since an untransferred toner, an external additive and an electrical discharge product remain on the surface of the image carrier to which the transfer process was applied, it is necessary to remove them by using cleaning device before the next image forming process. Various methods such as a method using a fur brush and a magnetic brush or the like, and a method using an elastic cleaning blade have been used as cleaning device for removing transfer residual toner or the like. Devices for scraping the toner by scrubbing the image carrier by using the cleaning blade is generally used, because the means is simple and cheap. Although noncontact corona dischargers are widely used as devices which charge the image carrier, contact (or proximity) chargers have been used in recent years for the reasons such as space-saving, low-cost, the simplification of power supply and scarce ozone generation.

A method (DC bias applying method) of applying only a direct current voltage (DC) voltage to a charging member, and a method (AC bias applying method) of applying a oscillation voltage obtained by overlapping a direct-current voltage to an alternating voltage are used for the contact charging. In the AC bias applying method, the uniformity of the surface potential is easily obtained because the alternating voltage component removes unevenness of the charge, the charge is controlled at a predetermined voltage by the direct-current voltage component. On the other hand, in recent years, quality of the image forming apparatus of this type has been improving. For example, a polymerization method is used in order to achieve high image quality, since a diameter of toner can be decreased, toner can be sphered, and a particle size distribution can be sharper by the method. The reproducibility of dots formed on the image carrier can be improved by decreasing the diameter of the toner, and developing property and transferring property can be improved by sphering the toner.

However, the following problems exist in the conventional electrophotographic method. Friction resistance between the elastic blade and the image carrier is originally large, and thereby the elasticity blade cannot be slided. However, fine particles or the like added to the toner detach from the toner and exist between the elasticity blade and the image carrier to improve lubrication.

The amount of the fine particles between the blade and the carrier is affected by the formed image. Since the fine particles are not supplied in non image-forming cycle, damages such as the fluttering sound of the blade, inversion of the blade and nicks or abrasion of the cleaning edge or the like are caused particularly at high temperature and high humidity, in which the frictional force increases. As a result, the performance of removing toner/external additive/electrical discharge product is degraded. It is known that these phenomena are accelerated by a contact charging method, and the increase in the friction of the image carrier is particularly remarkable in a contact charging method of applying an AC bias. The increasement further accelerates damages such as fluttering sound of the blade, inversion of the blade, and nick or abrasion of the cleaning edge and it is difficult to maintain a constant cleaning performance for a long term.

It is known that a blade cleaning of the spherical toner manufactured by a polymerization method or the like is difficult, and the cleaning performance is more remarkably deteriorated than in the case of a conventional toner having an indefinite shape, particularly when the damage of the blade is exacerbated. Because of the deterioration of the cleaning performance caused by damage to the blade, it is difficult to elongate life of a process cartridge or the like which contains the cleaning blade.

A method is disclosed (for instance, see Japanese Patent Application Laid-Open (JP-A) No. 08-190252) which suppresses the fluttering sound of the blade and the damage of the cleaning edge. In the method, charging voltage components including at least the alternating voltage is stopped when the charging voltage is applied to non-image forming areas.

However, since it is necessary to apply a proper alternating current for securing the charging performance in image forming areas, the effect obtained by the method is not sufficient particularly when images are continuously formed.

Another method (for instance, see JP-A No. 08-194364) is disclosed in which the frequency of the alternating voltage component of the charging voltage is changed according to measured temperature/humidity in the image forming apparatus. However, it is still necessary to apply the alternating voltage element for securing the charging performance. Therefore, the obtained effect is not sufficient.

On the other hand, a cleaning blade is proposed in which a low friction layer primarily composed of a rubber and a resin is formed on the edge part of the cleaning blade (for instance, see JP-A Nos. 8-27227, 9-258632 and 11-24522).

In producing the cleaning blade, a low friction layer forming material is provided by mixing a silicone powder, a fluororesin powder, and a poly methyl methacrylate (PMMA) powder or the like in with binders such as a urethane rubber, a silicone rubber, a silicone resin, a fluorine rubber, a fluororesin, and a nylon. The low friction layer forming material is then coated on the image-carrier contact part (edge part) of the cleaning blade by a dipping method or the like to form a low friction layer. Therefore, the friction between the image carrier and the cleaning blade can be reduced, and the fluttering sound and inversion of the cleaning blade can be prevented.

However, although the cleaning blade with the low friction layer is effective at first, the low friction layer is worn by the friction between the image carrier and the blade. Thereby the effect is not expected to last long.

In addition, a powder or a liquid lubricant is added to the polyurethane rubber which is a material constituting the cleaning blade in many proposed methods for improving the lubricity (for instance, see JP-A No. 7-306616).

However, for instance, a polyurethane rubber cleaning blade obtained by adding the lubricant powder becomes hard to damage the image carrier in some cases. When a polyurethane rubber cleaning blade obtained by adding the liquid lubricant is used, the liquid lubricant moves onto the surface of the cleaning blade to stain the image carrier.

As shown in FIGS. 10 and 11, the applicant of the invention has already proposed (for instance, JP-A No. 11-161125) a cleaning apparatus which includes: a cleaning blade 129 whose tip face downwards and contacts with the surface of an image carrier 101; a housing 137 for storing the toner scraped from the surface of the image carrier 101 by the cleaning blade 129; a lower seal 130 for receiving the toner and guiding the toner to the housing 137; a toner accumulating member 131 which is nearer to the housing 137 than the cleaning blade 129 and the lower seal 130 are and which accumulates the toner at the tip of the cleaning blade 129.

Thus, the toner removed from the surface of the image carrier is accumulated in the area (hereinafter referred to as "area A") whose periphery is defined by the cleaning blade 129, the lower seal 130, and the toner accumulating member 131. Consequently, the tip of the cleaning blade 129 is covered with the toner. External additives contained in the toner detach from the toner, and exist between the cleaning blade 129 and the photoreceptor. Thereby the external additives act as a lubricant, and the above problem can be prevented. Herein, numeral 101 designates a photoreceptor, and numeral 136 designates a long hole. Numeral 140 designates a conveying auger. θ is the contact angle between the cleaning blade 129 and the photoreceptor 101. T is the toner, and Pt is the pushing pressure from the toner T. G2 is the gap between the accumulating member 131 and cleaning blade 129. LAP is the part where the cleaning blade 129 and the accumulating member 131 overlap. R2 is the rotating direction of the photoreceptor 101. Numeral 111 designates a cleaning device.

However, as a result of further researches, the present inventors have found the following problems to be solved in the image forming method.

In the above method, the toner is temporarily accumulated near the tip of the blade, and the external additives contained in the toner detach from the toner. The external additives exist between the cleaning blade and the photoreceptor, and thereby the external additives act as a lubricant. Accordingly, the fluttering sound and inversion of the blade or the like are prevented. On the other hand, when the pressure of the toner at the tip of the cleaning blade 129 becomes excessive, the toner does not provide the lubricant effect but causes defective cleaning. Therefore, it is important to keep the amount and pressure of the toner at the tip of the cleaning blade 129 in the area A more uniform within the appropriate range.

SUMMARY OF THE INVENTION

The present invention has been made in view of the problems described above.

A first aspect of the invention is to provide an image forming apparatus comprising: a photoreceptor; a charging device which charges a surface of the photoreceptor; an exposing device which exposes the surface of the photoreceptor to form a latent image; a developing device which adheres a toner to the latent image to form a toner image on the surface of the photoreceptor; a transferring device which transfers the toner image to a transfer medium; and a cleaning device which removes a toner remaining on the surface of the photoreceptor after the toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; and a toner accumulating member which is disposed nearer to the housing than the cleaning blade and the lower seal are, wherein a lower end of the toner accumulating member is fixed; an upper end of the toner accumulating member is located above a lower end of the cleaning blade; the toner accumulating member accumulates the toner at a tip of the cleaning blade; the toner accumulating member has at least one opening; and the following condition is satisfied:

$$0\% < S(O)/S(C) \leqq 50\%$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

A second aspect of the invention is to provide an image forming apparatus comprising: a photoreceptor; a charging device which charges a surface of the photoreceptor; an exposing device which exposes the surface of the photoreceptor to form a latent image; a developing device which adheres a toner to the latent image to form a toner image on the surface of the photoreceptor; a transferring device which transfers the toner image to a transfer medium; and a cleaning device which removes a toner remaining on the surface of the photoreceptor after the toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; a first toner accumulating member; and a second toner accumulating member, wherein the first and second toner accumulating members are disposed nearer to the housing than the cleaning blade and the lower seal are; a lower end of the second toner accumulating member is fixed; a lower end of the first toner accumulating member is fixed by the lower seal and/or the housing; an upper end of the first toner accumulating member is located above a lower end of the cleaning blade; the first and second toner accumulating members accumulate the toner at a tip of the cleaning blade; the second toner accumulating member is more flexible than the first toner accumulating member; and the first toner accumulating member has at least one opening which is near to a portion fixed by the lower seal and/or the housing.

A third aspect of the invention is to provide a process cartridge comprising a cleaning device which removes a toner remaining on a surface of a photoreceptor after a toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; and a toner accumulating member which is disposed nearer to the housing than the cleaning blade and the lower seal are, wherein the process cartridge can be attached to and detached from an image forming apparatus; a lower end of the toner accumulating member is fixed; an upper end of the toner accumulating member is located above a lower end of the cleaning blade; the toner accumulating member accumulates the toner at a tip of the cleaning blade; the toner accumulating member has at least one opening; and the following condition is satisfied:

$$0\% < S(O)/S(C) \leqq 50\%$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

A fourth aspect of the invention is to provide a process cartridge comprising a cleaning device which removes a toner remaining on a surface of a photoreceptor after a toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; a first toner accumulating member; and a second toner accumulating member, wherein the first and second toner accumulating members are disposed nearer to the housing than the cleaning blade and the lower seal are; a lower end of the second toner accumulating member is fixed; a lower end of the first toner accumulating member is fixed by the lower seal and/or the housing; an upper end of the first toner accumulating member is located above a lower end of the cleaning blade; the first and second toner accumulating members accumulate the toner at a tip of the cleaning blade; the second toner accumulating member is more flexible than the first toner accumulating member; and the first toner accumulating member has at least one opening which is near to a portion fixed by the lower seal and/or the housing.

DESCRIPTION OF THE PRESENT INVENTION

Figure 1:
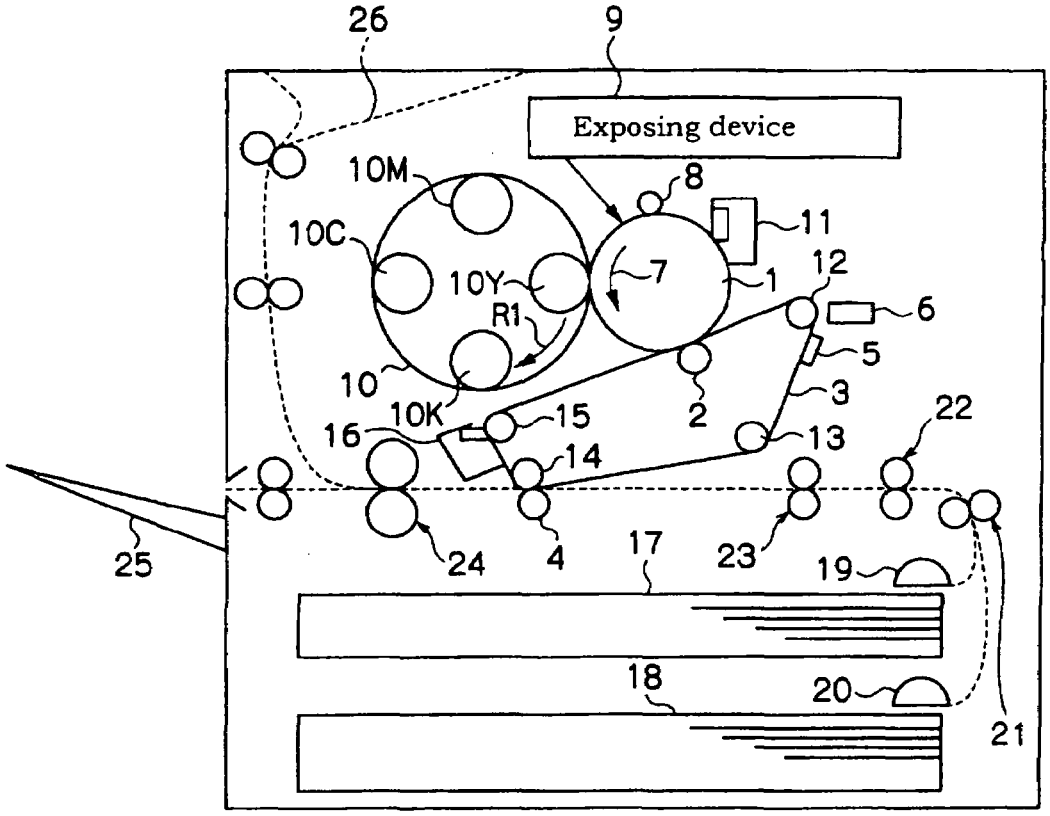
FIG. 1 is a schematic constitution view showing an example of an image forming apparatus of the present invention.

An embodiment of the invention is to provide an image forming apparatus comprising: a photoreceptor; a charging device which charges a surface of the photoreceptor; an exposing device which exposes the surface of the photoreceptor to form a latent image; a developing device which adheres a toner to the latent image to form a toner image on the surface of the photoreceptor; a transferring device which transfers the toner image to a transfer medium; and a cleaning device which removes a toner remaining on the surface of the photoreceptor after the toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; and a toner accumulating member which is disposed nearer to the housing than the cleaning blade and the lower seal are, wherein a lower end of the toner accumulating member is fixed; an upper end of the toner accumulating member is located above a lower end of the cleaning blade; the toner accumulating member accumulates the toner at a tip of the cleaning blade; the toner accumulating member has at least one opening; and the following condition is satisfied:

$$0\% < S(O)/S(C) < 50\%$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

The toner accumulating member may be disposed in the space between on the one hand the housing and on the other hand either the cleaning blade or the lower seal.

A distance H(O) between the lower end of the toner accumulating member and the upper end of the opening, and a distance H(C) between the lower end of the toner accumulating member and a position at the same height on the toner accumulating member as the lower end of the cleaning blade may satisfy the following condition:

$$0\% < H(O)/H(C) \leqq 50\%, \text{ and } H(C) - H(O) \geqq 4 \text{ mm}.$$

The flexibility of the fixed lower end of the toner accumulating member may be equal to or lower than that of the upper end portion of the toner accumulating member wherein the upper end portion is a portion above the lower end of the cleaning blade.

A distance H(M) between the lower end of the toner accumulating member and the position where the flexibility changes, and a distance H(O) between the lower end of the toner accumulating member and the upper end of the opening may satisfy the following condition.

$$H(M)>H(O)$$

A length L(C) of the toner accumulating member in the longitudinal direction of the toner accumulating member, a total sum L(O) of the lengths in the longitudinal direction of the openings wherein the number of the openings is designated by the letter n, and a total sum L(G) of the distances in the longitudinal direction between the adjacent openings may satisfy the following condition.

$$50\% \leqq L(O)/L(C)<100\%,\ L(G) \leqq L(O),\ \text{and}\ 10 \leqq L(C)/(L(O)/n)$$

The following condition may be satisfied.

$$H(C)-H(O) \geqq L(O)/n$$

The toner accumulating member may be composed of a combination of a plurality of plate members which are different in flexibility.

The lower end of the toner accumulating member having an equal or a lower flexibility than the upper end portion may be integrated with the housing.

The toner accumulating member may have only one opening.

The shape of the opening may be a circle, an oval or a modified polygon including two or more sides connected by arcs.

The toner may include a lubricant.

The lubricant may be a metal salt of a fatty acid.

The metal salt of a fatty acid may be zinc stearate.

The toner may include high-molecular alcohol particles.

The shape factor SF of the toner may be within the range of 115 to 145.

Another embodiment of the invention is to provide an image forming apparatus comprising: a photoreceptor; a charging device which charges a surface of the photoreceptor; an exposing device which exposes the surface of the photoreceptor to form a latent image; a developing device which adheres a toner to the latent image to form a toner image on the surface of the photoreceptor; a transferring device which transfers the toner image to a transfer medium; and a cleaning device which removes a toner remaining on the surface of the photoreceptor after the toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; a first toner accumulating member; and a second toner accumulating member, wherein the first and second toner accumulating members are disposed nearer to the housing than the cleaning blade and the lower seal are; a lower end of the second toner accumulating member is fixed; a lower end of the first toner accumulating member is fixed by the lower seal and/or the housing; an upper end of the first toner accumulating member is located above a lower end of the cleaning blade; the first and second toner accumulating members accumulate the toner at a tip of the cleaning blade; the second toner accumulating member is more flexible than the first toner accumulating member; and the first toner accumulating member has at least one opening which is near to a portion fixed by the lower seal and/or the housing.

The first and second toner accumulating members may be disposed in the space between on the one hand the housing and on the other hand either the cleaning blade or the lower seal.

A distance H(H1) between the lower end of the first toner accumulating member and the upper end thereof, a distance H(O1) between the lower end of the first toner accumulating member and the upper end of the opening, a distance H(H2) between the lower end of the second toner accumulating member and the upper end thereof, and a distance H(B) between the lower end of the first toner accumulating member and a position at the same height on the first toner accumulating member as the lower end of the cleaning blade may satisfy the following condition.

$$H(H1)>H(B) \geqq H(H2) \geqq H(O1),\ \text{and}\ H(B)-H(O1) \geqq 4\ \text{mm}$$

The second toner accumulating member may have at least one opening, and the total area S(O1) of the openings of the first toner accumulating member has and the total area S(O2) of the openings of the second toner accumulating member may satisfy the following condition.

$$S(O1)>S(O2)$$

A total opening area S(O) obtained by summing areas of all openings and an area S(C) of a rectangle defined by two sides having the same length as a length of the cleaning blade in its longitudinal direction and two sides having the same length as a distance between the lowest of the lower ends of the first and second toner accumulating members and a position at the same height on the toner accumulating members as the lower end of the cleaning blade may satisfy the following condition:

$$0\%<S(O2)/S(C) \leqq 50\%.$$

The flexibility of the upper end portion of the first toner accumulating member may be higher than that of the fixed lower end of the first toner accumulating member wherein the upper end portion is a portion above the lower end of the cleaning blade, and the flexibility of the second toner accumulating member may be higher than that of the fixed lower end of the first toner accumulating member.

The first toner accumulating member may comprise a combination of a plurality of plate members which are different in flexibility.

The lower end of the first toner accumulating member may be integrated with the housing, and the fixed lower end of the second toner accumulating member may be below the lower end of the opening of the first toner accumulating member integrated with the housing.

A distance H(M1) between the lower end of the first toner accumulating member and the position on the first toner accumulating member where the flexibility changes, and a distance H(O1) between the lower end of the first toner accumulating member and the upper end of the opening may satisfy the following condition.

$$H(M1)>H(O1)$$

The first toner accumulating member may have only one opening.

The shape of the opening may be a circle, a oval or a modified polygon including at least two sides connected by arcs.

The toner may include a lubricant.

The lubricant may be a metal salt of a fatty acid.

The metal salt of a fatty acid may be zinc stearate.

The toner may include high-molecular alcohol particles.

The shape factor SF of the toner may be within the range of 115 to 145.

Another embodiment of the invention is to provide a process cartridge comprising a cleaning device which removes a toner remaining on a surface of a photoreceptor after a toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; and a toner accumulating member which is disposed nearer to the housing than the cleaning blade and the lower seal are, wherein the process cartridge can be attached to and detached from an image forming apparatus; a lower end of the toner accumulating member is fixed; an upper end of the toner accumulating member is located above a lower end of the cleaning blade; the toner accumulating member accumulates the toner at a tip of the cleaning blade; the toner accumulating member has at least one opening; and the following condition is satisfied:

$$0\% < S(O)/S(C) \leqq 50\%$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

The toner accumulating member may be disposed in the space between on the one hand the housing and on the other hand either the cleaning blade or the lower seal.

A distance H(O) between the lower end of the toner accumulating member and the upper end of the opening, and a distance H(C) between the lower end of the toner accumulating member and a position at the same height on the toner accumulating member as the lower end of the cleaning blade may satisfy the following condition:

$$0\% < H(O)/H(C) \leqq 50\%, \text{ and } H(C) - H(O) \geqq 4 \text{ mm}.$$

The flexibility of the fixed lower end of the toner accumulating member may be equal to or lower than that of the upper end portion of the toner accumulating member wherein the upper end portion is a portion above the lower end of the cleaning blade.

A distance H(M) between the lower end of the toner accumulating member and the position where the flexibility changes, and a distance H(O) between the lower end of the toner accumulating member and the upper end of the opening may satisfy the following condition.

$$H(M) > H(O)$$

A length L(C) of the toner accumulating member in the longitudinal direction of the toner accumulating member, a total sum L(O) of the lengths in the longitudinal direction of the openings wherein the number of the openings is designated by the letter n, and a total sum L(G) of the distances in the longitudinal direction between the adjacent openings may satisfy the following condition.

$$50\% \leqq L(O)/L(C) < 100\%, \; L(G) \leqq L(O), \text{ and } 10 \leqq L(C)/(L(O)/n)$$

The following condition may be satisfied.

$$H(C) - H(O) \geqq L(O)/n$$

The toner accumulating member may be composed of a combination of a plurality of plate members which are different in flexibility.

The lower end of the toner accumulating member having an equal or a lower flexibility than the upper end portion may be integrated with the housing.

The toner accumulating member may have only one opening.

The shape of the opening may be a circle, an oval or a modified polygon including two or more sides connected by arcs.

The toner may include a lubricant.

The lubricant may be a metal salt of a fatty acid.

The metal salt of a fatty acid may be zinc stearate.

The toner may include high-molecular alcohol particles.

The shape factor SF of the toner may be within the range of 115 to 145.

Another embodiment of the invention is to provide a process cartridge comprising a cleaning device which removes a toner remaining on a surface of a photoreceptor after a toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; a first toner accumulating member; and a second toner accumulating member, wherein the first and second toner accumulating members are disposed nearer to the housing than the cleaning blade and the lower seal are; a lower end of the second toner accumulating member is fixed; a lower end of the first toner accumulating member is fixed by the lower seal and/or the housing; an upper end of the first toner accumulating member is located above a lower end of the cleaning blade; the first and second toner accumulating members accumulate the toner at a tip of the cleaning blade; the second toner accumulating member is more flexible than the first toner accumulating member; and the first toner accumulating member has at least one opening which is near to a portion fixed by the lower seal and/or the housing.

The first and second toner accumulating members may be disposed in the space between on the one hand the housing and on the other hand either the cleaning blade or the lower seal.

A distance H(H1) between the lower end of the first toner accumulating member and the upper end thereof, a distance H(O1) between the lower end of the first toner accumulating member and the upper end of the opening, a distance H(H2) between the lower end of the second toner accumulating member and the upper end thereof, and a distance H(B) between the lower end of the first toner accumulating member and a position at the same height on the first toner accumulating member as the lower end of the cleaning blade may satisfy the following condition.

$$H(H1) > H(B) \geqq H(H2) \geqq H(O1), \text{ and } H(B) - H(O1) \geqq 4 \text{ mm}$$

The second toner accumulating member may have at least one opening, and the total area S(O1) of the openings of the first toner accumulating member has and the total area S(O2) of the openings of the second toner accumulating member may satisfy the following condition.

$$S(O1)>S(O2)$$

A total opening area S(O) obtained by summing areas of all openings and an area S(C) of a rectangle defined by two sides having the same length as a length of the cleaning blade in its longitudinal direction and two sides having the same length as a distance between the lower end of the first toner accumulating member and a position at the same height on the toner accumulating members as the lower end of the cleaning blade may satisfy the following condition:

$$0\%<S(O2)/S(C)\leqq 50\%.$$

The flexibility of the upper end portion of the first toner accumulating member may be higher than that of the fixed lower end of the first toner accumulating member wherein the upper end portion is a portion above the lower end of the cleaning blade, and the flexibility of the second toner accumulating member may be higher than that of the fixed lower end of the first toner accumulating member.

The first toner accumulating member may comprise a combination of a plurality of plate members which are different in flexibility.

The lower end of the first toner accumulating member may be integrated with the housing, and the fixed lower end of the second toner accumulating member may be below the lower end of the opening of the first toner accumulating member integrated with the housing.

A distance H(M1) between the lower end of the first toner accumulating member and the position on the first toner accumulating member where the flexibility changes, and a distance H(O1) between the lower end of the first toner accumulating member and the upper end of the opening may satisfy the following condition.

$$H(M1)>H(O1)$$

The first toner accumulating member may have only one opening.

The shape of the opening may be a circle, a oval or a modified polygon including at least two sides connected by arcs.

The toner may include a lubricant.

The lubricant may be a metal salt of a fatty acid.

The metal salt of a fatty acid may be zinc stearate.

The toner may include high-molecular alcohol particles.

The shape factor SF of the toner may be within the range of 115 to 145.

Hereinafter, an image forming apparatus of the present invention will be described with reference to the accompanying drawings. Members having substantially similar functions are designated by the same reference numerals in the all figures.

FIG. 1 is a schematic constitution view showing an essential portion of a full-color printer as one example of an image forming apparatus of the invention. In FIG. 1, a photoreceptor drum (hereinafter referred simply to as "photoreceptor") 1 as image carrier is provided so as to be rotated in the direction of an arrow 7 by a motor (not shown). A charging roll (BCR) 8 as a charging device (charging device), an exposing device (ROS: exposing device) 9, a developing assembly (developing device) 10, a first BTR 2, which is a first transfer unit (transfer device), and a cleaning device 11 are arranged around the photoreceptor 1. The developing assembly 10 contains four developing devices (developing device) 10Y, 10M, 10C, 10K each including a developing agent containing each color toner for full-color development. The developing devices 10Y, 10M, 10C, 10K develop a latent image formed on the photoreceptor 1 by using the developing agents including the toners of yellow (Y), magenta(M), cyanogen (C), and black (K). When the developing agents including the toners are developed, the developing assembly 10 is rotated in the direction of an arrow R1 by a motor (not shown) so that the developing device of a required color contacts with the photoreceptor 1.

The toner image of each color developed on the photoreceptor 1 is sequentially transferred on an intermediate transfer belt (hereinafter referred simply to as "belt") 3 by the first BTR 2 and the toner images of four colors overlap. The belt 3 is stretched by rolls 12, 13, 14, 15. Among them, the roll 12 is connected with a driving source (not shown) and functions as a driving roll for driving the belt 3. The roll 13 functions as a tension roll for adjusting the tension of the belt 3. The roll 14 functions as a backup roll for the second BTR 4, which is a second transfer unit. A belt cleaner 16 is provided at such a position that the belt 3 is sandwiched between the belt cleaner 16 and the roll 15, and the residual toner remaining on belt 3 is scraped off by the cleaning blade.

A recording paper drawn out to a conveying passage from recording paper cassettes 17 and 18 by draw-out rolls 19 and 20 is fed by roll pairs 21, 22, and 23 to a nip part which is the contact part of the second BTR 4 with the belt 3. The toner image formed on the belt 3 is transferred onto the recording paper at the nip part. The toner image is thermally fixed by a fixing device (fixing device) 24, and the recording paper is discharged on a tray 25 or a tray 26 (on the upper surface of the main body).

A reflective photosensor 6 is arranged so as to face the belt 3, and the reflected light from a reflective foil 5 formed on the belt 3 is detected by the photosensor. The detection signal of the reflected light is used as a standard signal for controlling the timing of image formation conducted by a ROS 9 and the transfer timing of the toner image.

The developing devices 10Y, 10M, 10C, 10K have toner cartridges which can be exchanged, developing rolls for applying the development bias, toner supply devices for supplying the toner to the developing roll, and conveying devices.

In the image forming apparatus having the above constitution, the image is formed as follows. First, a voltage is applied to the BCR 8, and the surface of the photoreceptor 1 is uniformly charged negatively at a predetermine potential of the charging part. The latent image is then formed by the exposure by the ROS 9 such that image parts formed on the charged photoreceptor 1 have a predetermine exposing-part potential. That is, the ROS 9 is turned on and off based on the image signal supplied by a controller (not shown), and thereby the latent image corresponding to the image is formed.

A developing bias which was predetermined for each colour has been applied to a developing roll such as the developing device 10Y, and the latent image is developed by the toner when the latent image passes the developing roll, thus the latent image is visualized as a toner image. The toner image is transferred on the belt 3 by the first BTR 2, then transferred on a recording paper by the second BTR 4, then the recording paper is supplied to the fixing device 24. After four color toners are allowed to overlap on the belt at full-color printing, the toners are transferred onto the recording paper. The toner remaining on the photoreceptor 1 is removed by the cleaning device 11 and is collected.

<Cleaning Device>

Figure 2:
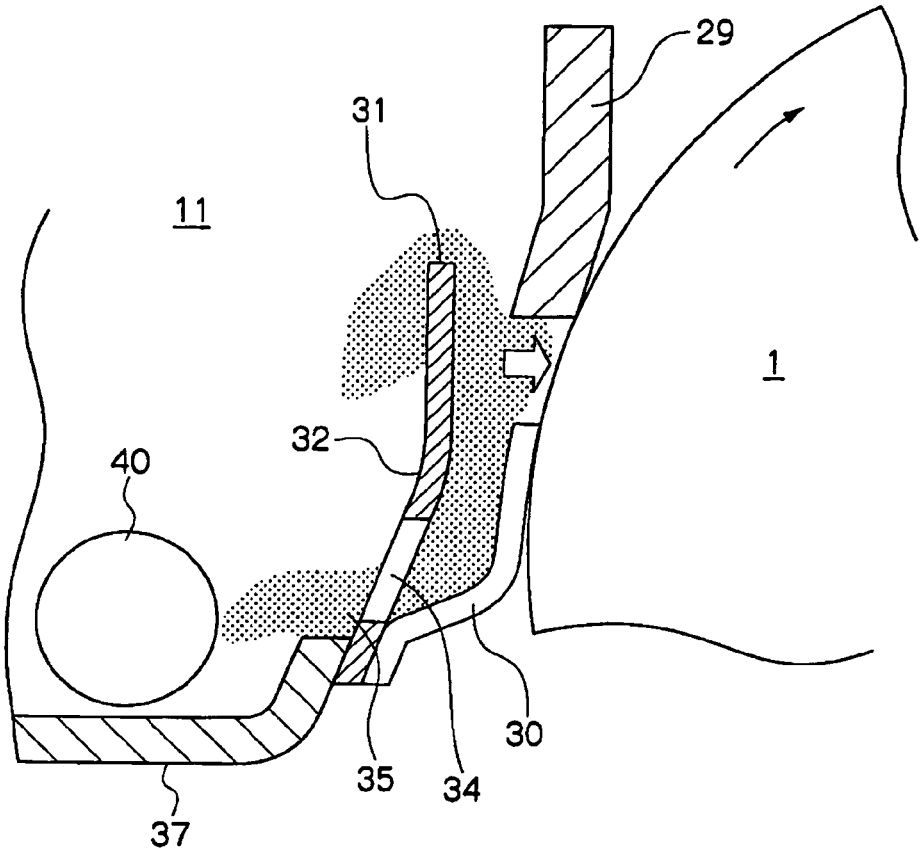
FIG. 2 is an enlarged view showing an essential portion of a cleaning device of the first embodiment of the invention.

Cleaning device 11 according to the first embodiment of the image forming apparatus of the invention will be described with reference to the accompanying drawings. Numeral 34 designates an opening. FIG. 2 is an enlarged view showing an essential portion of cleaning device. The cleaning device 11 shown in FIG. 2 has a cleaning auxiliary device including: a cleaning blade 29 for scraping a toner from the surface of the photoreceptor 1; a housing 37 for storing the toner scraped from the surface of the photoreceptor 1; a lower seal 30 for receiving the toner scraped from the surface of the photoreceptor 1 and guiding the toner to the housing; and a toner accumulating member 31 wherein the toner accumulating member 31 is arranged nearer to the housing 37 than the cleaning blade 29 and the lower seal 30 are, the lower end of the toner accumulating member 31 is fixed, the upper end of the toner accumulating member 31 is above the height of the lower end of the cleaning blade 29, and the toner accumulating member 31 accumulates the toner at the cleaning blade 29. In FIG. 2, in addition, a conveying auger 40 is provided, and the toner moved in the housing 37 is conveyed to an outlet (not shown). Numeral 32 designates the height at which the flexibility of the toner accumulating member 31 changes. Numeral 35 represents movement of the waste toner.

Figure 3:
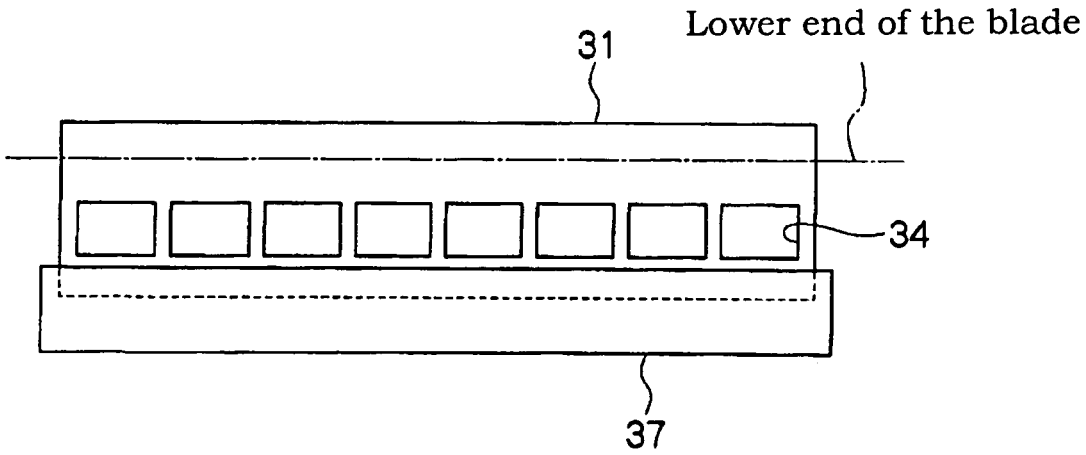
FIG. 3 is a front view of a toner accumulating member of a cleaning device of the first embodiment of the invention.

As shown in FIG. 3, in the cleaning device 11 according to the first embodiment of the image forming apparatus of the invention, a toner accumulating member 31 has openings 34, and the upper end of the toner accumulating member 31 is positioned above the lower end of the cleaning blade 29. FIG. 3 is a front view of the toner accumulating member of the cleaning device 11, and numeral 37 designates a housing as in FIG. 2.

Figure 4:
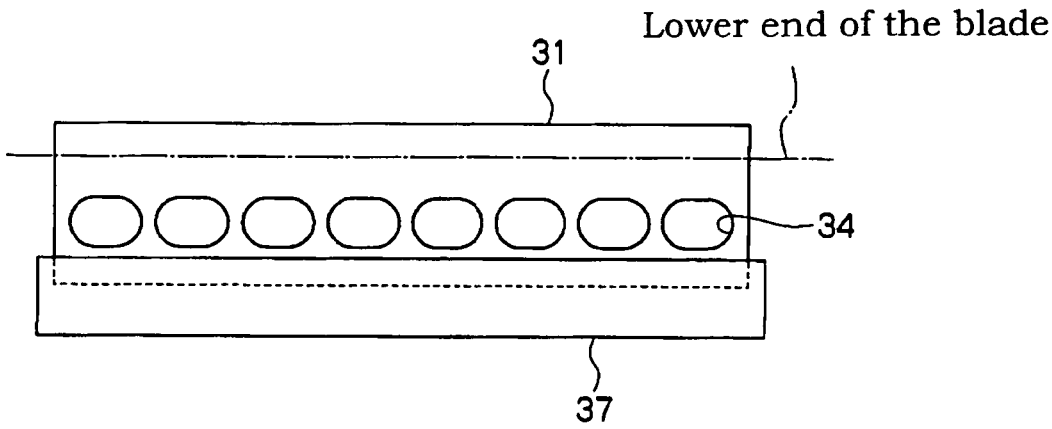
FIG. 4 is a front view of a toner accumulating member for showing an example of the shape of an opening of a toner accumulating member.

Herein, although the openings 34 have a rectangular shape in FIG. 3, the shape of the openings 34 is not limited. As shown in FIG. 4, the shape of the openings is preferably a circle, an oval or a modified polygon including at least two sides connected by arcs, and more preferably a circle or an oval. In FIG. 4, numeral 31 designates a toner accumulating member, and numeral 34 designates openings as in FIG. 3. Numeral 37 designates a housing. The shape of the openings 34 is preferably a circle, an oval or the modified polygon, because cracks at corners do not occur.

In not only the first embodiment but also in the second embodiment of the image forming apparatus of the invention described below, the shape of the openings 34 of the toner accumulating member 31 is preferably a circle, an oval or the modified polygon, and more preferably a circle or an oval.

As describe above, the toner accumulating member 31 has at least one opening 34, and the total opening area S(O) obtained by summing the areas of all openings 34 and the area S(C) of a rectangle of which a side has the same length as the width of the cleaning blade 29 in its longitudinal direction and of which another side which is orthogonal to the side has the same length as a distance between the lower end of the toner accumulating member 31 and a position at the same height as the lower end of the cleaning blade 29 in the toner accumulating member satisfy the following condition.

$$0\% < S(O)/S(C) \leqq 50\%$$

When the condition of $0\% < S(O)/S(C) \leqq 50\%$ is satisfied, the toner is stably held by the edge of the cleaning blade 29. On the other hand, when S(O)/S(C) is more than 50%, the toner is not stored, and thereby the effect of the invention can not be achieved. In other words, a fluttering sound of the cleaning blade is not suppressed and damages such as inversion of the blade and nick or abrasion of the cleaning edge cannot be prevented either. In the first embodiment of the image forming apparatus of the invention, it is preferable to satisfy $10\% \leqq S(O)/S(C) \leqq 50\%$, and it is more preferable to satisfy $14\% \leqq S(O)/S(C) \leqq 30\%$.

In the cleaning device 11 according to the first embodiment, a distance H(O) between the lower end of the toner accumulating member 31 and the upper end of the opening 34, and a distance H(C) between the lower end of the toner accumulating member 31 and a position at the same height as the lower end of the cleaning blade 29 preferably satisfy the following condition.

$$0\% < H(O)/H(C) \leqq 50\%, \text{ and } H(C) - H(O) \geqq 4 \text{ mm}.$$

When the distance H(O) and the distance H(C) satisfy $0\% < H(O)/H(C) \leqq 50\%$, the toner packing pressure in the vicinity of the edge is kept more uniform. On the other hand, when H(O)/H(C) is larger than 50%, the toner is not stored, and thereby the effect of the invention can not be achieved in some cases.

In the first embodiment of the image forming apparatus of the invention, it is preferable to satisfy $0\% < H(O)/H(C) \leqq 40\%$, and it is more preferable to satisfy $20\% \leqq H(O)/H(C)) \leqq 30\%$.

In the cleaning device 11 of the first embodiment of the image forming apparatus of the invention, the flexibility of the fixed lower end of the toner accumulating member 31 is preferably equal to or lower than that of the upper end portion which is a portion above the lower end of the cleaning blade.

Because of the low flexibility of the lower end of the toner accumulating member, deformation of the opening 34 is prevented and the excessive flexibility of the lower portion caused by the opening can be cancelled. Thereby proper discharge of the toner by the opening can be continuously conducted.

A distance H(M) between the lower end of the toner accumulating member and the position where the flexibility changes, and a distance H(O) between the lower end of the toner accumulating member and the upper end of the opening preferably satisfy the following condition.

$$H(M) > H(O)$$

It is preferable that in the cleaning device 11 of the first embodiment of the image forming apparatus of the invention, the length L(C) of the toner accumulating member 31 in the longitudinal direction, the total sum L(O) of the lengths in the longitudinal direction of the openings 34 wherein the total number of the openings is designated by n, and the total sum L(G) of the intervals in the longitudinal direction between the adjacent openings preferably satisfy the following condition:

$$50\% \leqq L(O)/L(C) < 100\%,\ L(G) \leqq L(O), \text{ and } 10 \leqq L(C)/(L(O)/n).$$

Images having no unevenness can be obtained by satisfying the condition. On the other hand, when the condition is not satisfied, difference is caused in the accumulation state of the toner and the toner circularity in the area where the toner is accumulated between in the vicinity of both ends of each of the openings 34 and in the vicinity of the center; consequently, images are uneven in some cases. In the invention, it is more preferable to satisfy $60\% \leqq L(O)/L(C) \leqq 99\%$. It is also more preferable to satisfy $20 \leqq L(C)/(L(O)/n)$.

In the cleaning device 11 of the first embodiment of the image forming apparatus of the invention, a distance H(O) between the lower end of the toner accumulating member 31 and the upper end of the opening 34, a distance H(C) between the lower end of the toner accumulating member 31 and a position at the same height as the lower end of the cleaning blade 29, and a length L(O)/n, which is a length in the longitudinal direction per each of the openings 34 satisfy the following condition.

$$H(C)-H(O)\geqq L(O)/n$$

The distortion distribution of the upper end is suppressed by satisfying this condition, and the distortion of the upper end suppresses the irregularity in the toner accumulation pressure in the vicinity of the blade edge.

In the cleaning device 11 of the first embodiment of the image forming apparatus of the invention, it is preferable that the toner accumulating member 31 comprises a combination of a plurality of plate members which are different in flexibility. In this case, the toner accumulating member can be designed such that the toner accumulating member is adapted to changes in material characteristics caused by the openings.

Figure 5:
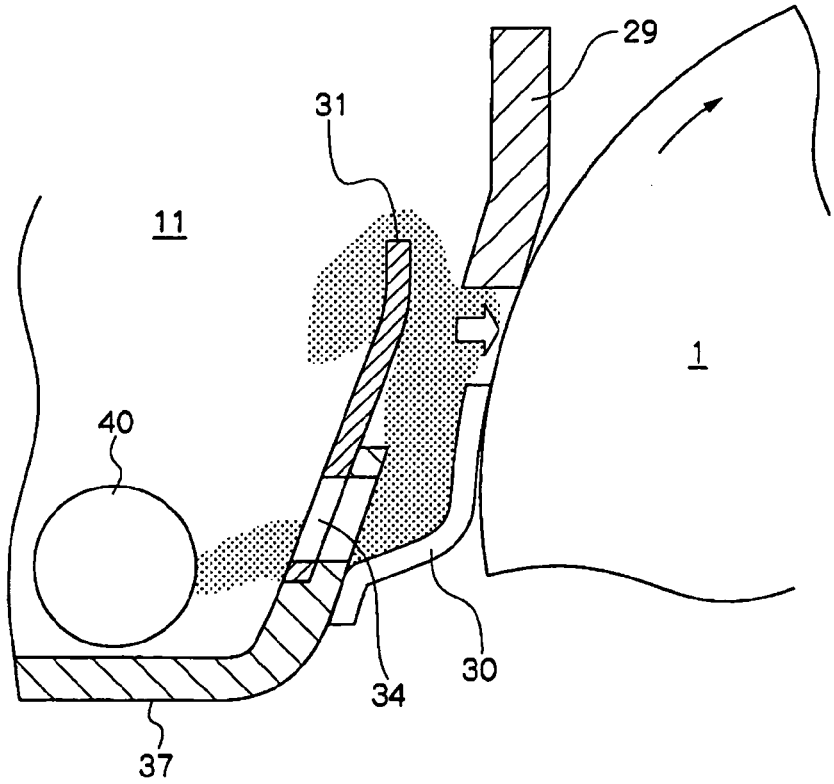
FIG. 5 is an enlarged view showing an essential portion of a toner accumulating member in which the lower end of the toner accumulating member 31 of the first embodiment of the invention is integrated with a housing 37.

As shown in FIG. 5, the lower end of the toner accumulating member 31, which has a flexibility equal to or a lower than that of the upper end portion, is preferably integrated with the housing 37. In the same way as FIG. 2, in FIG. 5, numeral 1 designates a photoreceptor, and numeral 11 designates a photoreceptor cleaning device. Numeral 29 designates a cleaning blade, numeral 30 designates a lower seal, and numeral 34 designates an opening, and numeral 40 designates a conveying auger.

It is preferable for the cleaning device 11 of the first embodiment of the image forming apparatus of the invention to have only one opening 34. If the part beside the opening 34 is stiff, the opening can be wide since adverse influences such as distortion of the upper part caused by the opening do not occur. In this case, since the opening extends wide, the distribution of the toner accumulation pressure in the longitudinal direction is uniform and excellent images can be formed.

Figure 6:
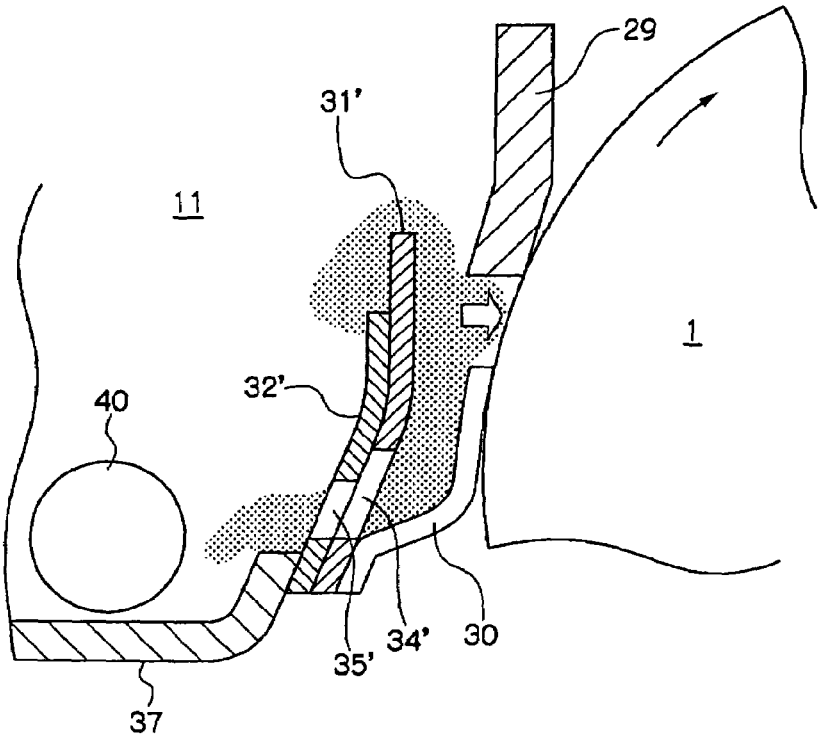
FIG. 6 is an enlarged view showing an essential portion of a toner accumulating member of a cleaning apparatus of the second embodiment of the invention.
Figure 7:
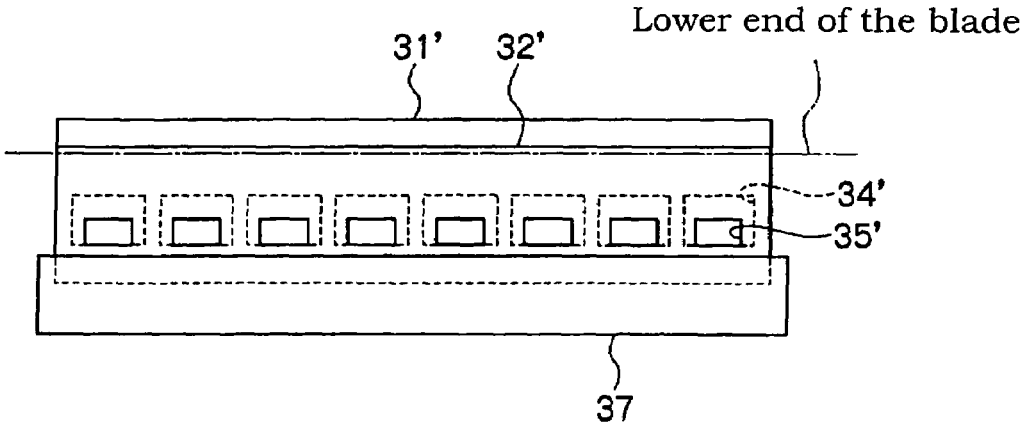
FIG. 7 is a front view of a toner accumulating member of a cleaning apparatus of the second embodiment of the invention.

Cleaning device 11 of the second embodiment of the image forming apparatus of the invention will be described with reference to the accompanying drawings. FIG. 6 is an enlarged view showing an essential portion of cleaning device 11. FIG. 7 is a front view of a toner accumulating member of cleaning device 11. The cleaning device 11 shown in FIG. 6 has a cleaning auxiliary device including: a cleaning blade 29 for scraping the toner from the surface of the photoreceptor 1; a housing 37 for storing the toner scraped from the surface of the photoreceptor 1; a lower seal 30 for receiving the toner scraped from the surface of the photoreceptor 1 and guiding the toner to the housing; a first toner accumulating member 31' for accumulating the toner at the cleaning blade 29; and a second toner accumulating member 32', wherein the first toner accumulating member is arranged nearer to the housing 37 than the cleaning blade 29 and the lower seal 30 are, the lower end of the first toner accumulating member is fixed, and the upper end of the first toner accumulating member is positioned above the lower end of the cleaning blade 29. Numeral 40 designates a conveying auger, and numeral 35' designates an opening.

The upper end of the first toner accumulating member 31' is above the lower end of the cleaning blade 29, and the first toner accumulating member 31' has at least one opening 34' near a part fixed by the lower seal 30 and the housing 37. On the other hand, it is preferable for the second toner accumulating member 32' to have a higher flexibility than that of the first toner accumulating member 31', and the second toner accumulating member is preferably positioned nearer to the housing 37 than the first toner accumulating member 31' is.

In this case, the first toner accumulating member 31' provides the toner accumulating function. The second toner accumulating member 32' makes it possible to maintain the toner accumulation pressure more stably. The amount of the toner which moves from the opening 34' of the first toner accumulating member 31' to the housing 37 is usually regulated by the second toner accumulating member 32'. When the inflow of the toner is excessive, the second toner accumulating member 32' having a higher flexibility than the first toner accumulating member 31' bends suitably so as to maintain a constant toner accumulation pressure in the toner accumulation part. As a result, the toner accumulation pressure does not increase excessively, and the excellent image can be formed over a long period of time.

In the cleaning device 11 of the second embodiment of the image forming apparatus of the invention, a distance H(H1) between the lower end of the first toner accumulating member 31' and the upper end thereof, a distance H(O1) between the lower end of the first toner accumulating member 31' and the upper end of the opening 34', a distance H(H2) between the lower end of the second toner accumulating member 32' and the upper end thereof, and a distance H(B) between the lower end of the first toner accumulating member 31' and a position at the same height as the lower end of the cleaning blade 29 preferably satisfy the following condition.

$$H(H1)>H(B)\geqq H(H2)\geqq H(O1),\text{ and } H(B)-H(O)\geqq 4\text{ mm}$$

If the conditions of H(H1)≧H(H2)≧H(O1), and H(B)−H(O1)≧4 mm are satisfied, the upper end of the second toner accumulating member 32' is above the opening of the first toner accumulating member 31, but below the upper end of the first toner accumulating member 31'. In such a constitution, the second toner accumulating member 32' relates to only the flow of the toner through the opening of the first toner accumulating member 31'. The ununiformity of the toner accumulation pressure in the longitudinal direction in the vicinity of the edge of the second toner accumulating member 32' can be suppressed by the restriction on the height of the opening 34' of the first toner accumulating member 31' relative to the blade edge.

In the cleaning device 11 of the second embodiment of the image forming apparatus of the invention, the second toner accumulating member 32' has at least one opening 35', and the total area S(O1) of the openings 34' of the first toner accumulating member and the total area S(O2) of the openings 35' of the second toner accumulating member preferably satisfy the following condition.

$$S(O1)>S(O2)$$

In that constitution, the second toner accumulating member 32' has the opening 35', and the total area of the openings 35' of the second toner accumulating member 32' is smaller than the total area of the openings 34' of the first toner accumulating member 31'. The discharge amount of the toner can be changed according to the influx of the toner, and the toner accumulation pressure can be maintained constant while the toner is continuously circulated in and discharged from the toner accumulation part.

In the cleaning device 11 of the second embodiment of the image forming apparatus of the invention, the area S(C) of a rectangle of which one side has the same length as the width of the cleaning blade in the longitudinal direction and of which another side which is orthogonal to the side has the same length as a distance between the lower end of the first toner accumulating member and a position at the same height as the lower end of the cleaning blade, and the total area S(O2) of the openings of the second toner accumulating member preferably satisfy the following condition:

$$0\% < S(O2)/S(C) \leqq 50\%.$$

When 0%<S(O2)/S(C)≦50% is satisfied, the inflow toner is stably retained at the blade edge. On the other hand, if S(O2)/S(C) is larger than 50%, the toner may not be stored, and the effect of the invention is not obtained in some cases.

Figure 8:
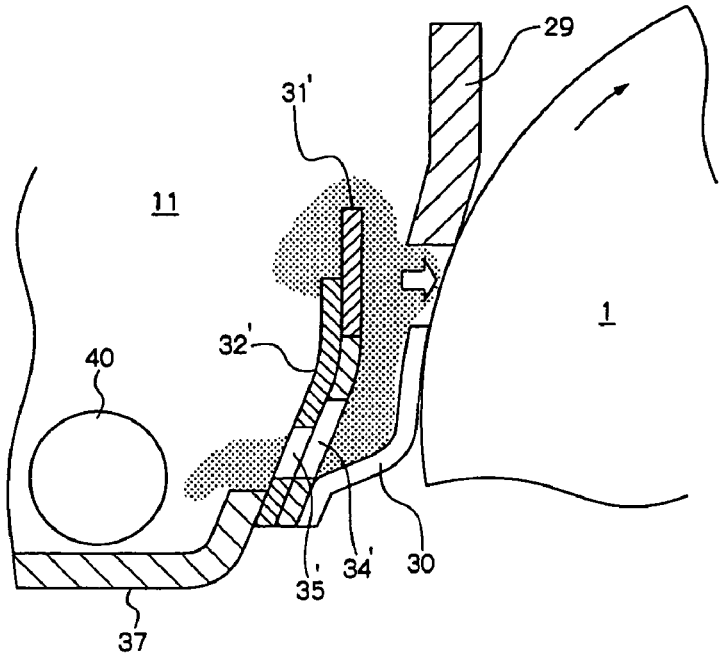
FIG. 8 is an enlarged view showing an essential portion of a toner accumulating member 31 whose flexibility at the lower end is different from that the flexibility at the upper end in the second embodiment of the invention.

In the cleaning device 11 of the second embodiment of the image forming apparatus of the invention, as shown in FIG. 8, the flexibility of the upper end portion of the first toner accumulating member 31' which is the portion above the lower end of the cleaning blade 29 is preferably higher than that of the lower end. The flexibility of the second toner accumulating member 32' is preferably higher than that of the fixed lower end of the first toner accumulating member 31'.

The first toner accumulating member 31' preferably comprises a combination of a plurality of plate members which are different in flexibility. In FIG. 8, numeral 1 designates a photoreceptor, and numeral 29 designates a cleaning blade as in FIG. 6. Numeral 30 designates a lower seal, and numerals 34', 35' designate openings, and numeral 37 designates a housing, and numeral 40 designates a conveying auger.

Figure 9:
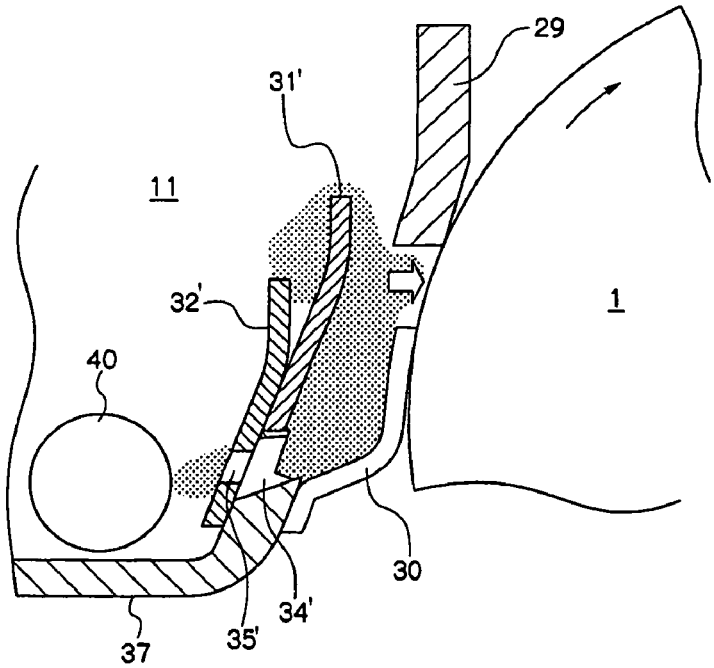
FIG. 9 is an enlarged view showing an essential portion of a toner accumulating member 31 in which the lower end of the toner accumulating member 31 of the second embodiment of the invention is integrated with a housing 37.
Figure 10:
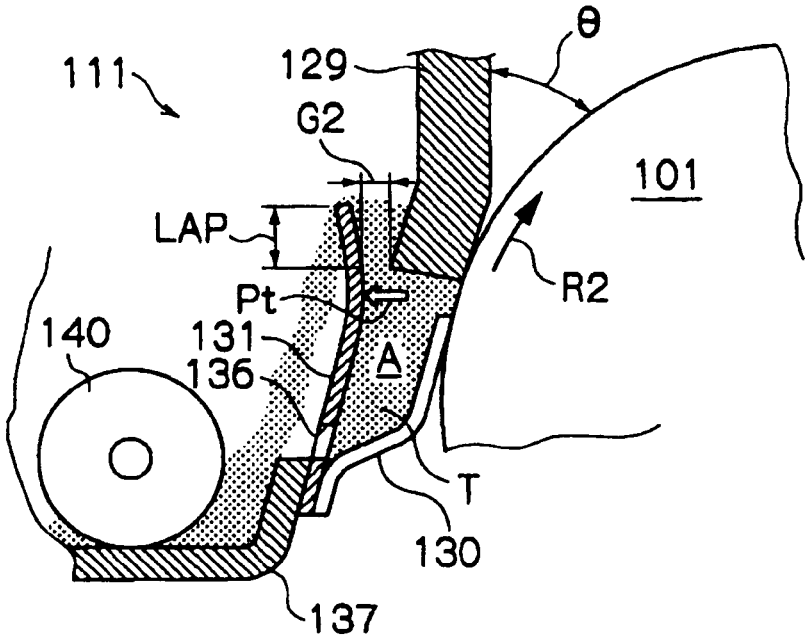
Fig. 10 Related Art
FIG. 10 is an enlarged view showing an essential portion of another example of a conventional cleaning apparatus.
Figure 11:
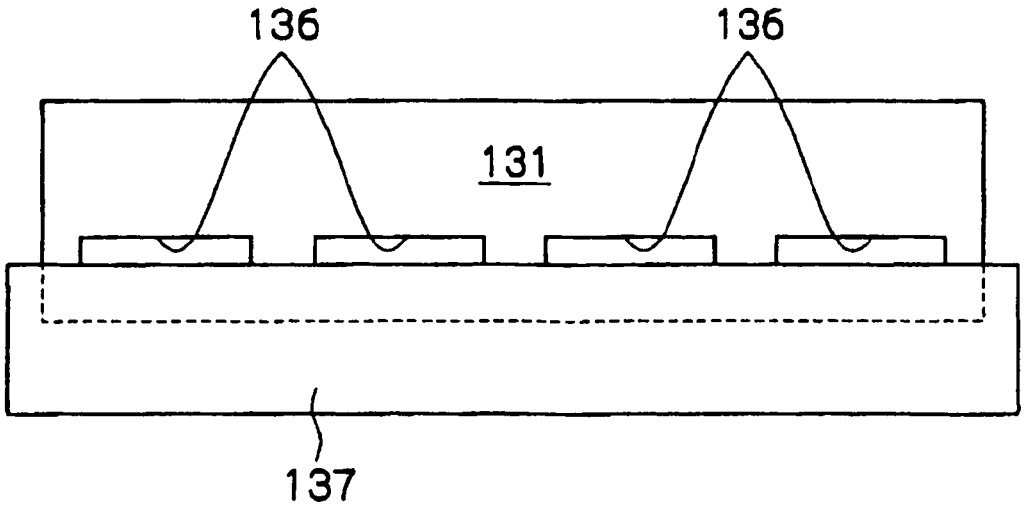
Fig. 11 Related Art
FIG. 11 is a front view of an accumulating sheet in another example of a conventional cleaning apparatus.

In the cleaning device 11 of the second embodiment of the image forming apparatus of the invention, as shown in FIG. 9, the lower end of the first toner accumulating member 31' is preferably integrated with the housing 37, and the fixed lower end of the second toner accumulating member is preferably below the lower end of the opening of the first toner accumulating member integrated with the housing. As in FIG. 8, in FIG. 9, numeral 1 designates a photoreceptor, and numeral 29 designates a cleaning blade. Numeral 30 designates a lower seal, numeral 32' designates a second toner accumulating member, and numeral 34', 35' designate openings, and numeral 40 designates a conveying auger.

As described above, the upper end of the first toner accumulating member 31' is composed of a different material from that of the lower end, and thereby the first toner accumulating member can be adapted to the change in material characteristics caused by the opening.

In the cleaning device 11 of the second embodiment of the image forming apparatus of the invention, a distance H(M1) between the lower end of the first toner accumulating member 31' and the position where the flexibility changes, and a distance H(O1) between the lower end and the upper end of the opening 34' preferably satisfy the following condition. The change in flexibility owing to the opening can be suppressed by satisfying the following condition.

$$H(M1) > H(O1)$$

In the cleaning device 11 of the second embodiment of the image forming apparatus of the invention, it is preferable for the toner accumulating member to have only one opening. If the part beside the opening is stiff, the opening can be wide since adverse influences such as the distortion of the upper part owing to the opening do not occur. When non-opening portions occupy only a small proportion, the distribution of the toner accumulation pressure in the longitudinal direction is uniform, and thereby excellent images can be formed.

The cleaning device used for the image forming apparatus of the invention is not particularly limited as long as the cleaning device includes the above-described cleaning auxiliary device. A urethane rubber, a silicone rubber, a fluorine rubber, a chloroprene rubber, and a butadiene rubber or the like can be used as a material of the cleaning blade of the cleaning device. Among them, it is preferable to use a polyurethane elastic body in view of abrasion resistance. Polyurethane synthesized through the addition reaction of isocyanate with polyols and various hydrogen-containing compounds is generally used as the polyurethane elastic body. The polyols may be selected from polyether polyols such as polypropylene glycol and polytetramethylene glycol, and polyester polyols such as adipate polyols, polycaprolactam polyols, and polycarbonate polyols. The polyisocyanate may be selected from aromatic polyisocyanates such as tolylene diisocyanate, 4,4' diphenylmethane diisocyanate, polymethylenepolyphenylpolyisocyanate, and toluidine diisocyanate, and aliphatic polyisocyanates such as hexamethylene diisocyanate, isophorone diisocyanate, xylylene diisocyanate, and dicyclohexylmethane diisocyanate. Urethaneprepolymer is synthesized from these substances and a curing agent is added to the urethaneprepolymer. The resultant mixture is injected to a predetermined mold and is cross-linked and cured. The mixture is then aged at normal temperature to prepare the polyurethane elastic body.

A dihydric alcohol such as 1,4-butanediol, and a polyhydric alcohol having three or more alcoholic hydroxyl groups such as trimethylolpropane and pentaerythritol are usually used together as the curing agent. The cleaning blades having the following physical properties can be used; hardness (JIS A scale) of 50 to 90; Young's modulus (kg/cm$^2$) of 40 to 90; 100% modulus (kg/cm$^2$) of 20 to 65; 300% modulus (kg/cm$^2$) of 70 to 150; tensile strength (kg/cm$^2$) of 240 to 500; elongation (%) of 290 to 500; impact resilience (%) of 30 to 70; tear strength (kg/cm$^2$) of 25 to 75; and permanent elongation (%) of 4.0 or less. The contact pressure of the blade is preferably within the range of 10 to 60 (gf/cm) and the contact angle is preferably within the range of 17 to 30(°).

As described above, the first embodiment of the image forming apparatus of the invention have a common constitution except the cleaning device. Hereinafter, components of the cleaning device of the image forming apparatus of the invention will be described.

<Toner>

The toner used in the image forming apparatus may be produced by any method. The following methods of producing toner can be used: a kneading-pulverizing method of kneading, pulverizing, and classifying a binder resin, a colorant, a releasing agent, and optionally a charge controlling agent or the like; a method in which the shape of particles obtained by the kneading-pulverizing method is changed by mechanical impact power or thermal energy; an emulsification-polymerization flocculation method in which polymerizable monomers of a binder resin are emulsion-polymerized, the resultant dispersion and dispersions of a colorant, a releasing agent, and optionally a charge controlling agent or the like are mixed and flocculation is allowed to occur, and the flocculates are fused by heat; a suspension polymerization method in which the solution of polymerizable monomers to form a binder resin, a colorant, a releasing agent, and optionally a charge controlling agent or the like are suspended in an aqueous solvent and the monomers are allowed to polymerize; and a dissolution suspension method in which solutions of a binder resin, a colorant, a releasing agent, and optionally a charge controlling agent or the like are suspended in an aqueous solvent to form particles.

Known methods such as a method in which the toner obtained by any of the above methods is used as a core and a core shell structure is formed by adhering aggregated particles and heat-fusing the particles can be used. The suspension polymerization method, the emulsification-polymerization flocculation method, and dissolution suspension method are particularly preferable in view of shape control and particle-size distribution control. Most preferred is the emulsification-polymerization flocculation method.

The toner used for the image forming apparatus of the invention includes a binder resin, a colorant and a releasing agent or the like, and optionally includes silica and/or a charge controlling agent. The volume average particle diameter is preferably within the range of 2 to 12 μm, and more preferably 3 to 9 μm. The average shape index ($ML^2/A$: ML represents the absolute maximum length of a toner particle, and A represents the projected area of the toner particle) of the toner is preferably within the range of 115 to 145. The image having better developing property, better transferring property and high quality can be formed by using the toner.

Examples of the binder resin include a homopolymer or a copolymer of: styrenes such as styrene and chlorostyrene; mono olefins such as ethylene, propylene, butylene and isoprene; vinyl esters such as vinyl acetate, vinyl propionate, vinyl benzoate and vinyl butyrate; α-methylene aliphatic monocarboxylates such as methyl acrylate, ethyl acrylate, butyl acrylate, dodecyl acrylate, octyl acrylate, phenyl acrylate, methylmethacrylate, ethyl methacrylate, butyl methacrylate and dodecyl methacrylate; vinylethers such as vinyl methyl ether, vinyl ethyl ether and vinyl butyl ether; and vinyl ketones such as vinyl methyl ketone, vinyl hexyl ketone, and vinyl isopropenyl ketone. Particularly, examples of the typical binder resins include polystyrene, styrene-acrylate alkyl copolymer, styrene-methacrylate alkyl copolymer, styrene-acrylonitrile copolymer, styrene-butadiene copolymer, styrene-maleic anhydride copolymer, polyethylene and polypropylene. In addition, the examples include polyesters, polyurethanes, epoxy resins, silicone resins, polyamides, modified rosins and paraffin waxes.

Examples of the colorant include magnetic powder such as magnetite and ferrite, carbon black, aniline blue, calco oil blue, chrome yellow, ultramarine blue, DUPON oil red, quinolin yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.1. pigment yellow 17, C.I. pigment blue 15:1, C.I. pigment blue 15:3.

Examples of the releasing agent include a low-molecular polyethylene, a low-molecular polypropylene, Fischer-Tropsch wax, Montand wax, carnauba wax, rice wax, and candelilla wax.

The charge controlling agent may be added to the toner in accordance with necessary. Although known charge controlling agents can be used, azo metal complex compounds, metal complex compounds of salicylic acid and resin type charge controlling agents having polar groups can be preferably used. When the toner is manufactured in a wet process, materials which are not easily dissolved in water are preferably used in view of control of ion intensity and decrease of water pollution.

The toner may be a magnetic toner which includes a magnetic material or a non-magnetic toner which does not include a magnetic material.

A lubricant is preferably added to toner surface. Examples of the lubricant include solid lubricants such as graphite, molybdenum disulfide, talc, fatty acids and metal salts of fatty acids; higher alcohols; low-molecular weight polyolefins such as polypropylene, polyethylene and polybutene; silicones having softening points; aliphatic amides such as oleic acid amide, erucic acid amide, ricinoleic amide and stearic acid amide; plant waxes such as carnauba wax, rice wax, candelilla wax, Japanese wax and jojoba oil; animal waxes such as yellow beewax; mineral and oil waxes such as Montand wax, ozokerite, ceresin, paraffin wax, microcrystalline wax and Fischer-Tropsch wax; and modified materials thereof. A lubricant or a plurality of lubricants may be used.

The lubricant is preferably a higher alcohol that greatly decreases the friction or a metal salt of a fatty acid (aluminum stearate, indium stearate, gallium stearate, zinc stearate, lithium stearate, magnesium stearate, sodium stearate, aluminum palmitate, and aluminum oleate or the like). The metal salt of a fatty acid is particularly preferably zinc stearate.

The amount of the zinc stearate to be added is preferably within the range of 0.01 to 2.0 parts by mass, and more preferably 0.05 to 0.5 parts by mass, based on 100 parts by mass of the toner. When the amount of the zinc stearate is less than 0.01 part by mass, sufficient lubrication is not provided in some cases. When the amount is more than 2.0 parts by mass, excessive amount of toner adheres to the image carrier and image bleed is likely to occur at high temperature and high humidity, and the charging characteristic of the toner is likely to be deteriorated.

Although the number of carbon atoms in the higher alcohol added to the toner is not particularly limited, higher aliphatic alcohols having 16 to 150 carbon atoms are preferable. Aliphatic alcohols having 20 to 120 carbon atoms are more preferable and aliphatic alcohols having 30 to about 100 carbon atoms are still more preferable. The amount of the higher aliphatic alcohols to be added is preferably within the range of 0.01 to 3.0 parts by mass, and more preferably 0.05 to 1.5 parts by mass, based on 100 parts by mass of the toner. When the amount of higher aliphatic alcohols is less than 0.01 parts by mass, sufficient lubrication is not provided in some cases. When the amount is more than 3.0 parts by mass, excessive amount of toner adheres to the image carrier to cause image bleed at high temperature and high humidity or to deteriorate the charging characteristic of the toner in some cases.

The toner used in the invention may include fine particles such as inorganic fine particles, organic fine particles, and complex fine particles obtained by providing inorganic fine particles on organic fine particles; the fine particles are added with the aim of, for example removing adhering matter or degraded substance on the photoreceptor. Inorganic fine particles are particularly preferable, which have excellent polishing properties.

As the inorganic fine particles, various inorganic oxides, nitrides and borides are preferably used, such as silica, alumina, titania, zirconia, barium titanate, aluminium titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

Small diameter inorganic oxides having a primary particle diameter of 40 nm or less may be used to control the flow property and charging property of the toner. Inorganic oxides having a large diameter may be used to reduce adherence and controlling electrification of the toner. Although known inorganic oxide fine particles can be used, it is preferable to use silica and titania together for controlling electrification precisely. The dispersibility and flow property of the toner are improved by applying surface treatment to the small diameter inorganic fine particles.

The inorganic fine particles may be treated with titanium coupling agents such as tetrabutyl titanate, tetraoctyl titanate, isopropyltriisostearoyl titanate, isoproplytridecylbenzenesulfonyl titanate and bis(dioctylpyrophosphate)oxyacetate titanate; and silane coupling agents such as γ-(2-aminoethyl) aminopropyltrimethoxy silane, γ-(2-aminoethyl)aminopropylmethyldimethoxy silane, γ-methacryloxypropyltrimethoxy silane, N-β-(N-vinyl benzyl aminoethyl) γ-aminopropyltrimethoxy silane hydrochloride, hexamethyldisilazane, methytrimethoxy silane, butyltrimethoxy silane, isobutyltrimethoxy silane, hexyltrimethoxy silane, octyltrimethoxy silane, decyltrimethoxy silane, dodecyltrimethoxy silane, phenyltrimethoxy silane, o-methyphenyltrimethoxy silane and p-methylphenyltrimethoxy silane. The inorganic fine particles may be treated with metal salts of higher fatty acids such as silicone oil, aluminum stearate, zinc stearate and calcium stearate so that hydrophobicity is imparted to the fine particles.

Examples of the organic fine particles include styrene resin particles, styrene acrylic resin particles, polyester resin particles and urethane resin particles. When the particle diameter thereof is too small, the grinding ability is likely to be insufficient. When the particle diameter thereof is too large, scars are likely to be generated on the surface of the electrophotographic photoreceptor. Therefore the average particle diameter is preferably within the range of 5 to 1000 nm, more preferably 5 to 800 nm and more preferably 5 to 700 nm.

The sum of the amount of the organic fine particles and the amount of the lubricant described above is preferably 0.6% by mass or more.

The toner used in the invention can be manufactured by mixing the toner particles and the external additives by a henschelmixer or a V blender or the like. When the toner particles are manufactured in a wet process, it is also possible to add the additives to the surface of the toner in the wet process.

When the toner is used as a color toner, the toner is preferably used after mixed with a career. The career may be iron powder, glass bead, ferrite powder, nickel powder or powder obtained by coating a surface thereof with a resin. The mixing ratio of the career and the toner can be properly set.

<Photoreceptor>

The photoreceptor used in the invention comprise a conductive substrate, a photosensitive layer provided on the outer circumferential face of the conductive substrate, and an optional surface layer provided on the photosensitive layer. The photosensitive layer may be composed of a single layer, or composed of a charge generating layer and a charge transporting layer. In the latter case, respective functions of charge generation and charge transportation are provided by separate layers.

As the conductive substrate, a metal drum made of aluminum, copper, iron, stainless steel, zinc, or nickel may be used. Or the substrate may be prepared by vapor-depositing a metal such as aluminum, copper, gold, silver, platinum, palladium, titanium, nickel-chrome, stainless steel, copper or indium on a sheet, a paper, a plastic, or a glass. Or the substrate may be prepared by vapor-depsiting a conductive metal compound such as indium oxide or a tin oxide on a sheet, a paper, a plastic, or a glass. Or the substrate may be prepared by laminating a sheet, a paper, a plastic, or a glass with a metal foil. Or the substrate may be prepared by coating a sheet, a paper, a plastic, or a glass with a dispersion including a binder and a conductive material selected from carbon black, indium oxide, tin oxide, an antimony oxide powder, a metal powder, copper iodide and the like.

The shape of the conductive substrate is not limited to a drum shape, and may be a sheet shape and a plate shape. When the conductive substrate is a metal pipe, its surface may be unprocessed or may have been subjected to a process such as a mirror cutting, an etching, an anodic oxidation, a rough cutting, a centerless grinding, a sand blast, and a wet honing.

An undercoat layer may be optionally provided on the substrate.

Examples of the materials included in the undercoat layer include organometal compounds. Specific examples thereof include organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds, and aluminum coupling agents; antimony alkoxide compounds; germanium alkoxide compounds; indium alkoxide compounds; indium chelate compounds; manganese alkoxide compounds; manganese chelate compounds; tin alkoxide compounds; tin chelate compounds; aluminum silicon alkoxide compounds; aluminum titanium alkoxide compounds; aluminum zirconium alkoxide compounds. Organic zirconium compound, organic titanyl compound, and organic aluminium compound are preferable because photoreceptors including such compounds have low residual potentials and excellent electrophotographic characteristics.

The undercoat layer may further include a silane coupling agent such as vinyltrichlorosilane, vinyltrimethoxysilane, vinyltriethoxysilane, vinyltris(2-methoxyethoxy)silane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, or β-3,4-epoxycyclohexyltrimethoxysilane. The undercoat layer may further include a known binder resin such as polyvinyl alcohol, polyvinyl methyl ether, poly-N-vinyl imidazole, polyethylenoxide, ethyl cellulose, methyl cellulose, ethylene-acrylate copolymer, polyamide, polyimide, casein, gelatin, polyethylene, polyester, a phenol resin, a (vinyl chloride)-(vinyl acetate) copolymer, an epoxy resin, polyvinylpyrrolidone, polyvinyl pyridine, polyurethane, polyglutamic acid or polyacrylic acid, which are used conventionally as components in an undercoat layer.

These mixing ratio can be properly set. An electron transporting pigment can be mixed/dispersed in the undercoat layer. The electron transporting pigment may be an organic pigment such as a perylene pigment disclosed in JP-A No. 47-30330, a bisbenzimidazoleperylene pigment, a polycyclic quinone pigment, an indigo pigment, a quinacridone pigment, an inorganic pigment such as a bisazo pigment having an electron-attracting substituent such as a cyano group, a nitro group, a nitroso group or a halogen atom, or a phthalocyanine pigment; or an inorganic pigment such as zinc oxide or titanium oxide. Among the above pigments, perylene pigments, bisbenzimidazoleperylene pigments and polycyclic quinone pigments are preferable since they have high electronic mobility. The amount of the electron transporting pigment is preferably 95% by mass or less, and more preferably 90% by mass or less since film defect is caused by lower strength of the undercoat layer with an excessive amount of the electron transporting pigment.

The undercoat layer may further contain a metal oxide having an appropriate resistance in order to have an improved leak resistance. Herein, though any metal oxide fine particles can be used, it is preferable to use metal oxide fine particles having a powder resistance of $10^2$ to $10^{11}$ Ω·cm, and it is more preferable to use metal oxide fine particles such as fine particles of tin oxide, titanium oxide and zinc oxide. When the powder resistance of the metal oxide is smaller than $10^{11}$ Ω·cm, sufficient leak resistance cannot be obtained in some cases. When the powder resistance of the metal oxide is larger than $10^2$ Ω·cm, the residual potential increases in some cases.

The metal oxide fine particles can be a mixture of different kinds of fine particles which have been subjected to different surface treatments or a mixture of different kinds of fine particles which have different particle diameters.

Surface treatments may be optionally applied to the metal oxide fine particles. Coupling agents or the like can be used in the surface treatment. Any coupling agents capable of providing desired photoreceptor characteristics can be used. Specific examples of the coupling agents include silane coupling agents such as vinyltrimethoxysilane, γ-methacryloxypropyl-tris(β-methoxyethoxy)silane, β-(3,4-epoxy cyclohexyl)ethyltrimethoxysilane, γ-glycidoxypropyltrimethoxysilane, vinyltriacetoxysilane, γ-mercaptopropyltrimethoxysilane, and γ-aminopropyltriethoxysilane, N-β-(amino ethyl)-γ-aminopropyltrimethoxysilane, N-β-(amino ethyl)-γ-aminopropylmethylmethoxysilane, N, N-bis(β-hydroxy ethyl)-γ-aminopropyltriethoxysilane, and γ-chloropropyltrimethoxysilane. However, the coupling agents are not limited thereto. A mixture of coupling agents can also be used.

Any known surface treatment methods can be used and, for example, a dry process or a wet process can be used. When a dry-process surface treatment is applied, a coupling agent dissolved in an organic solvent or water is dropped to the metal oxide fine particles or sprayed with dry air or nitrogen gas onto the fine particles while the fine particles are stirred by a mixer or the like having a large shear force, so that the surface of the fine particles is processed uniformly. The temperature when the coupling agent is dropped or sprayed is preferably 50° C. or higher. After the coupling agent is dropped or sprayed, the coupling agent is baked at 100° C. or higher. The temperature and time of the baking treatment is not limited as long as desired electrophotographic characteristics can be obtained. In the dry process, the metal oxide fine particles are heated and dried before the surface treatment with the coupling agent, and surface adsorption water can be removed. By removing surface adsorption water before processing, it becomes possible to make the surface of the metal oxide fine particles adsorb the coupling agent uniformly. It is also possible to heat and dry the metal oxide fine particles while the metal oxide fine particles are stirred by a mixer or the like having a large shear force.

In a wet process, after the metal oxide fine particles are dispersed in a solvent by a stirrer, a supersonic wave, a sand mill, an attritor, a ball mill or the like, a coupling agent solution is added to the dispersion, stirred and dispersed. Then, the solvent on the metal oxide fine particles is removed. In this way, the surface of the fine particles is processed uniformly. After the solvent is removed, the coupling agent is baked at 100° C. or more. The temperature and time of the baking are not limited as long as desired electrophotographic characteristics are obtained. The surface adsorption water on the metal oxide fine particles can be removed in the wet process before the surface treatment with the coupling agent. The surface adsorption water can be removed by heating and drying the fine particles as in the dry process, or by adding the fine particles to the solvent for the surface treatment and stirring and heating the mixture, or by adding the fine particles to a solvent so that an azeotrope between water and the solvent is formed and heating the solvent.

The amount of the silane surface treatment agent relative to the metal oxide fine particles has to be controlled so that desired electrophotographic characteristics are obtained. The electrophotographic characteristic is affected by an amount of the surface treatment agent adhered to the metal oxide fine particles after the surface treatment. The amount of the adhered surface treatment agent is determined from an intensity of Si and an intensity of a main metal of the metal oxide in fluorescent X-ray analysis. The preferable Si intensity in the fluorescent X-ray analysis is $1.0\times10^{-5}$ to $1.0\times10^{-3}$ times the intensity of the main metal of the metal oxide. When the Si intensity is less than $1.0\times10^{-5}$ times the intensity of the main metal of the metal oxide, image quality defect such as fog may easily occur. When the Si intensity is more than $1.0\times10^{-3}$ times the intensity of the main metal of the metal oxide, defects such as a rise of the residual potential may easily occur.

As the binder resins of the coating liquid for the undercoat layer, a known polymer resin compound can be used such as an acetal resin such as polyvinyl butyral; a polyvinyl alcohol resin; casein; a polyamide resin; a cellulose resin; gelatin; a polyurethane resin; a polyester resin; a methacrylate resin; an acrylic resin; a polyvinyl chloride resin; a polyvinyl acetate resin; a (vinyl chloride)-(vinyl acetate)-(maleic anhydride) resin; a silicone resin; a silicone-alkyd resin; a phenol resin; a phenol-formaldehyde resin; a melamine resin; or an urethane resin. A charge transporting resin having a charge transporting group and a conductive resin such as polyaniline can also be used. Among them, resins which are not dissolved by the coating solvent of the upper layer are preferable, and phenol resins, phenol-formaldehyde resins, melamine resins, urethane resins and epoxy resins are particularly preferable.

In addition, various additives can be added to the coating liquid for forming the undercoat layer in order to enhance electrical characteristics, environmental stability, image quality or the like. Known materials can be used as the additives. Examples thereof include quinone compounds such as chloranil, bromoanyl and anthraquinone; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)1,3,4 oxadiazole; xanthone compounds; thiophene compounds; electron transporting substances such as diphenoquinone compounds such as 3,3',5,5'tetra-t-butyldiphenoquinone; polycyclic condensed compounds; electron transporting pigments such as azo compounds; zirconium chelate compounds; titanium chelate compounds; aluminum chelate compounds; titanium alkoxide compounds; organic titanium compounds; and silane coupling agents.

Although the silane coupling agent is used for the surface treatment of the metal oxide, the silane coupling agent may be further added to the coating liquid as an additive. Specific examples of the silane coupling agent that can be added to the coating liquid include vinyltrimethoxysilane, γ-methacryloxypropyl-tris(β-methoxyethoxy)silane, β-(3, 4-epoxy cyclohexyl)ethyltrimethoxysilane, γ-glycidoxypropyltrimethoxysilane, vinyltriacetoxysilane, γ-mercaptopropyltrimethoxysilane, and γ-aminopropyltriethoxysilane, N-β-(amino ethyl)-γ-aminopropyltrimethoxysilane, N-β-(amino ethyl)-γ-amonopropylmethymethoxysilane, N,N-bis(β-hydroxyethyl)-γ-aminopropyltriethoxysilane, and γ-chloropropyltriethoxysilane. Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetra isopropyl titanate, tetra n-butyl titanate, butyl titanate dimer, tetra (2-ethylhexyl)titanate, titan acetyl acetonate, polytitan acetyl acetonate, titan octylene glycolate, titan lactate ammonium salt, titan lactate, titan lactate ethyl ester, titantriethanol aminate, and polyhydroxy titan stearate.

Examples of the aluminum chelate compound include aluminum isopropylate, monobutoxy aluminum diisopropylate, aluminum butylate, diethyl acetacetate aluminum diisopropylate, and aluminum tris (ethyl acetacetate).

A single compound selected from the above comounds may be used. A mixture of compounds selected from the above compounds or a polycondensation product of compounds selected from the above compounds may also be used.

Components of the undercoat layer are mixed and/or dispersed by conventional methods which use a ball mill, a roll mill, a sand mill, an attritor, a supersonic wave or the like. The mixing/dispersing is conducted in an organic solvent, and any organic solvent can be used provided the solvent dissolves the organometal compounds and resins and gelling or flocculation does not occur when the electron transporting pigment is mixed with and dispersed in the solvent. For instance, an usual organic solvent can be used such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxan, tetrahydrofuran, methylene chloride, chloroform, chlorobenzene, or toluene. A mixture of organic solvents can also be used. The thickness of the undercoat layer is generally within the range of 0.1 to 30 μm, and preferably within the range of 0.2 to 25 μm.

Usual coating methods such as a blade coating method, a meyer bar coating method, a spray coating method, a dip coating method, a bead coating method, an air knife coating method, and a curtain coating method can be used when the undercoat layer is formed. The wet film is dried to form the undercoat layer. The wet film is usually dried at such a temperature that the solvent evaporates to form a dry film. Particularly, when the substrate has been subjected to an acid-solution treatment or a boehmite treatment, there could be defects on the surface of the substrate; consequently, it is preferable to provide an intermediate layer.

In the invention, the charge generating substance may be any known charge generating substance. The charge generating agent for infrared light may be a phthalocyanine pigment, squarylium, bisazo, trisazo, perylene or dithioketopyrrolopyrrole. The charge generating agent for visible light may be a condensed polycyclic pigment, a bisazo, a perylene, a trigonalselen, or a metal oxide fine particle sensitized with a dye. Particularly, phthalocyanine pigments are preferable because of its excellent characteristics. When phthalocyanine pigments are used, the electrophotographic photoreceptor has a high sensitivity and a high stability over repeated use. Generally, phthalocyanine pigments each can take several crystal forms, and the crystal forms are not limited as long as a sensitivity suitable for the use can be obtained. Preferable examples of the charge generating substance to be used include chlorogallium phthalocyanine, dichlorotin phthalocyanine, hydroxygallium phthalocyanine, non-metal phthalocyanine, oxytitanyl phthalocyanine, and chloroindium phthalocyanine.

The crystal of the phthalocyanine pigment can be manufactured by dry-grinding the phthalocyanine pigment manufactured by a known method mechanically by using an automatic mortar, a planet mill, a vibrating mill, a CF mill, a roller mill, a sand mill, a kneader or the like, or by wet-grinding the pigment with a solvent by using a ball mill, a sand mill, and a kneader or the like after dry-grinding. Examples of the solvent include aromatic compounds (such as toluene and chlorobenzene), amides (such as dimethylformamide and N-methylpyrrolidone), aliphatic alcohols (such as methanol, ethanol, and butanol), aliphatic polyhydric alcohols (such as ethylene glycol, glycerin, and polyethylene glycol), aromatic alcohols (such as benzyl alcohol and phenethyl alcohol), esters (such as acetic ether and butyl acetate), ketones (such as acetone and methyl ethyl ketone), dimethylsulfoxide, ethers (such as diethyl ether and tetrahydrofaran), a mixture thereof, and a mixture of water and solvents selected from these organic solvents. The amount of the solvent is preferably 1 to 200 parts by mass per one part by mass of the pigment crystal, and more preferably 10 to 100 parts by mass per one part by mass of the pigment crystal. The processing temperature is preferably within the range of −20° C. to the boiling point of the solvent, and more preferably within the range of −10 to 60° C.

A grinding auxiliary agent such as sodium chloride and Glauber's salt can be also used at the grinding. The amount of the grinding auxiliary agent may be 0.5 to 20 times as much as the pigment, and preferably, 1 to 10 times as much as the pigment. The phthalocyanine pigment crystal manufactured by a known method can be modified by an acid pasting or by a combination of an acid pasting and the dry-grinding or the wet-grinding. The acid used for the acid pasting is preferably sulfuric acid and its concentration is preferably 70 to 100%, and more preferably 95 to 100%.

The dissolution temperature is preferably within the range of −20 to 100° C., and more preferably within the range of −10 to 60° C. The amount of the concentrated sulfuric acid is preferably 1 to 100 times as much as the mass of the phthalocyanine pigment crystal, and more preferably 3 to 50 times as much as the mass of the phthalocyanine pigment crystal. Water or a mixture solvent of water and an organic solvent may be used in an arbitrary amount in order to precipitate the crystal.

Although the temperature for precipitation is not particularly limited, it is preferable to cool the solvent by using ice or the like to prevent heat generation.

Binder resins included in the electric charge generating layer can be selected from various insulating resins, and can be selected from organic photoconductive polymers such as poly-N-vinyl carbazole, polyvinyl anthracene, polyvinyl pyrene, and polysilane. Preferable examples of the binder resins include insulating resins such as a polyvinylacetal resin, a polyarylate resin (such as a polycondensation product of bisphenol A and phthalic acid), a polycarbonate resin, a polyester resin, a phenoxy resin, a (vinyl chloride)-(vinyl acetate) copolymer, a polyamide resin, an acrylic resin, a polyacrylamide resin, a polyvinyl pyridine resin, a cellulose resin, an urethane resin, an epoxy resin, casein, a polyvinyl alcohol resin, and a polyvinylpyrrolidone resin. Examples of the binder resins are not limited to these examples.

A binder or a combination of binders may be used for forming the electric charge generating layer. Particularly, polyvinyl acetal resin is preferable among them.

The compounding ratio (mass ratio) of the electric charge generating substance and the binder resin is preferably within the range of 10:1 to 1:10. Known organic solvents, for instance, an alcohol, an aromatic compound, a halogenated hydrocarbon, a ketone, a ketone alcohol, an ether, and an ester or the like can be arbitrarily selected and used for the coating liquid. For instance, usual organic solvents can be used such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

A single solvent or a mixture of solvents may be used for forming the coating liquid for forming the charge generating layer. Any solvent may be used as long as the solvent can dissolve constitution units of the binder resin.

Components of the coating liquid may be dispersed by a roll mill, a ball mill, a vibrating ball mill, an attritor, a sand mill, a colloid mill, or a paint shaker. Usual coating methods may be used such as a blade coating method, a wire bar coating method, a spray coating method, a dip coating method, a bead coating method, an air knife coating method, and a curtain coating method when the charge generating layer is provided.

It is effective in obtaining high sensitivity and high stability to disprese the particles such that the particles have a particle size of 0.5 μm or smaller, preferably 0.3 μm or smaller, and more preferably 0.15 μm or smaller.

In addition, the surface treatment can be applied to the electric charge generating substance for enhanced stability of electrical characteristics and the prevention of an image defect or the like. Although a coupling agent or the like can be used as the surface treatment agent, the surface treatment agent is not limited to the coupling agent. Examples of the coupling agent used for the surface treatment include the silane coupling agents such as vinyltrimethoxysilane, γ-methacryloxypropyl-tris(β-methoxyethoxy)silane, β-(3,4-epoxy cyclohexyl)ethyltrimethoxysilane, γ-glycidoxypropyltrimethoxysilane, vinyltriacetoxysilane, γ-mercaptopropyltrimethoxysilane, and γ-aminopropyltriethoxysilane, N-β-(amino ethyl)-γ-aminopropyltrimethoxysilane, N-β-(amino ethyl)-γ-aminopropylmethylmethoxysilane, N,N-bis(β-hydroxy ethyl)-γ-aminopropyltriethoxysilane, and γ-chloropropyltriethoxysilane. Preferable examples of the coupling agent include vinyltriethoxysilane, vinyltris(2-methoxyethoxysilane), 3-methacryloxypropyltrimethoxysilane, 3-glycidoxypropyltrimethoxysilane, 2-(3,4-epoxy cyclohexyl)ethyltrimethoxysilane, N-2-(amino ethyl)3-aminopropyltrimethoxysilane, N-2-(amino ethyl)3-aminopropylmethyldimethoxysilane, 3-aminoproyltriethoxysilane, N-phenyl-3-aminopropyltrimethoxysilane, 3-mercaptopropyltrimethoxysilane, and 3-chloropropyltrimethoxysilane.

Organic zirconium compounds such as zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium caprylate, zirconium naphthenate, zirconium laurate, zirconium stearate, zirconium isostearate, methacrylate zirconium butoxide, stearate zirconium butoxide and isostearate zirconium butoxide can be used. Organic titanium compounds such as tetraisopropyl titanate, tetranormal butyl titanate, butyl titanate dimer, tetra (2-ethylhexyl) titanate, titan acetylacetonate, poly titanateacetylacetonate, titan octyleneglycolate, titan lactate ammonium salt, titan lactate, titan lactate ethylester, titan triethanolaminate, and polyhydroxy titanstearate, and organic aluminum compounds such as aluminium isopropylate, mono butoxy aluminium diisopropylate, aluminium butyrate, diethyl acetoacetate aluminium diisopropylate and aluminium tris (ethylacetoacetate) can be also used.

In addition, various additives can be added to the coating liquid for forming the electric charge generating layer in order to enhance electrical characteristics, enhance image quality, or the like. Known materials can be used as the additives. Examples thereof include quinone compounds such as chloranil, bromoanyl, and anthraquinone; tetracyanoquinodimethane compounds; fluorenone compounds such as 2,4,7-trinitrofluorenone, 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)1,3,4 oxadiazole; xanthone compounds; thiophene compounds; electron transporting substances such as diphenoquinone compounds such as 3,3',5,5'tetra-t-butyldiphenoquinone; polycyclic condensed compounds; electron transporting pigments such as azo compounds; zirconium chelate compounds; titanium chelate compounds; aluminum chelate compounds; titanium alkoxide compounds; organic titanium compounds; and silane coupling agents.

Examples of the silane coupling agents include vinyltrimethoxysilane, γ-methacryloxypropyl-tris(β-methoxyethoxy)silane, β-(3,4-epoxy cyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(amino ethyl)-γ-aminopropyltrimethoxysilane, N-β-(amino ethyl)-γ-amonopropylmethymethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium caprylate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetra isopropyl titanate, tetra n-butyl titanate, butyl titanate dimer, tetra (2-ethylhexyl) titanate, titan acetyl acetonate, polytitan acetyl acetonate, titan octylene glycolate, titan lactate ammonium salts, titan lactate, titan lactate ethyl ester, titantriethanol aminate, and polyhydroxy titan stearate.

Examples of the aluminum chelate compounds include aluminum isopropylate, monobutoxy aluminum diisopropylate, aluminum butylate, diethyl acetacetate aluminum diisopropylate, and aluminum tris (ethyl acetacetate).

A compound selected from these compounds may be used or a mixture of these compounds or a polycondensation product of these compounds may be used.

Usual coating methods such as a blade coating method, a wire bar coating method, a spray coating method, a dip coating method, a bead coating method, an air knife coating method, and a curtain coating method can be used when the electric charge generating layer is formed.

Any known charge transporting substances can be used in the invention as the charge transporting substances in the charge transporting layer, and the following charge transporting substances can be cited as examples. Examples of the electron hole transporting substances include oxadiazole derivatives such as 2,5-bis(p-diethylaminophenyl)-1,3,4-oxadiazole; pyrazoline derivatives such as 1,3,5-triphenylpyrazoline, 1-[pyridyl-(2)]-3-(p-diethylaminostyryl)-5-(p-diethylaminostyryl)pyrazoline; aromatic tertiary amine compounds such as triphenylamine, tri(P-methyl)phenylamine, N,N'-bis(3,4-dimethylphenyl)biphenyl-4-amine, dibenzylaniline, 9,9-dimethyl-N,N'-di(p-tolyl)fluorenone-2-amine; aromatic tertiary diamine compounds such as N,N'-diphenyl-N,N'-bis(3-methylphenyl)-[1,1-biphenyl]-4,4'-diamine; 1,2,4-triazine derivatives such as 3-(4'dimethylaminophenyl)-5,6-di-(4'-methoxyphenyl)-1,2,4-triazine; hydrazone derivatives such as 4-diethylaminobenzaldehyde-1,1-diphenylhydrazone, 4-diphenylaminobenzaldehyde-1,1-diphenylhydrazone, and [p-(diethylamino)phenyl(1-naphthyl)phenylhydrazone; quinazoline derivatives such as 2-phenyl-4-styryl-quinazoline; benzofuran derivatives such as 6-hydroxy-2,3-di(p-methoxyphenyl)-benzofuran; α-stilbene derivatives such as p-(2,2-diphenylvinyl)-N,N'-diphenylaniline; enamine derivatives; carbazole derivatives such as N-ethyl carbazole; and poly-N-vinyl carbazole and derivatives thereof. Examples of the electron transporting substances include quinone compounds such as chloranil, bromoanyl and anthraquinone; tetracyanoquinodimethane compounds; fluorenone compounds such as 2,4,7-trinitrofluorenone, 2,4,5,7-tetranitro-9-fluorenone; oxadiazole compounds such as 2-(4-biphenyl)-5-(4-t-butylphenyl)1,3,4-oxadiazole, 2,5-bis(4-naphthyl)-1,3,4-oxadiazole, 2,5-bis(4-naphthyl)-1,3,4-oxadiazole, 2,5-bis(4-diethylaminophenyl)1,3,4oxadiazole; xanthone compounds; thiophene compounds; and diphenoquinone compounds such as 3,3,5,5'tetra-t-butyldiphenoquinone. Examples of the electron transporting substances include polymers which have on a main chain or a side chain thereof groups derived from compounds selected from the above compounds.

A charge transporting substance can be used or a combination of charge transporting substances may be included in the charge transporting layer.

Although any known binder resins may be included in the charge transporting layer, resins which can form electrical insulating films are preferable. Examples thereof include polycarbonate resins, polyester resins, methacrylate resins, acrylic resins, polyvinyl chloride resins, polyvinylidene chloride resins, polystyrene resins, polyvinyl acetate resins, styrene-butadiene copolymer, polyvinylidene chloride-acrylonitrile copolymer, vinyl chloride-vinyl acetate copolymer, vinyl chloride-vinyl acetate-maleic anhydride copolymer, silicone resins, silicone-alkyd resins, phenol formaldehyde resins, styrene-alkyd resins, poly-N-carbazole, polyvinyl butyral, polyvinylformal, polysulfone, casein, gelatin, polyvinyl alcohol, ethyl cellulose, phenol resins, polyamide, carboxy-methylcellulose, chloridization vinylidene polymer waxes, and polyurethane. A binder may be included in the charge transporting layer or a combination of binders may be included in the charge transporting layer.

Polycarbonate resins, polyester resins, methacrylate resins and acrylic resins are preferable because of their excellent compatibility with the charge transporting substance, solubility to the solvent and strength.

Although the compounding ratio (mass ratio) of the binder resin and the charge transporting substance can be arbitrarily set in any case, it is necessary to note deterioration of the electric characteristic and the film strength. The thickness of the charge transporting layer may be within the range of 5 to 50 μm, and preferably within the range of 10 to 40 μm. Usual methods such as a blade coating method, a wire bar coating method, a spray coating method, a dip coating method, a bead coating method, an air knife coating method, and a curtain coating method can be used when the charge transporting layer is formed. Usual organic solvents such as dioxane, tetrahydrofuran, methylene chloride, chloroform, chlorobenzene and toluene can be used for the coating. Only an organic solvent or a mixture of organic solvents may be used.

In addition, additives such as antioxidants and light stabilizers can be included in a photosensitive layer so as to prevent the photoreceptor from being deteriorated by ozone or an oxidizing gas generated in the electrophotographic apparatus or by light and heat.

In this case, examples of the antioxidants include hindered phenols, hindered amines, paraphenylene diamines, aryl alkanes, hydroquinones, spirochromans, spiroindanones, derivatives thereof, organic sulfur compounds, and organic phosphorus compounds.

Examples of phenol-based antioxidants include 2,6-di-t-butyl-4-methyl phenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2-hydroxybenzyl)-4-methyl phenyl acrylate, 4,4'-butylidene-bis-(3-methyl-6-t-butyl-phenol), 4,4'-thio-bis-(3-methyl-6-t-butyl phenol), 1,3,5-tris(4-t-butyl-3-hydroxy-2,6-dimethyl benzyl)isocyanurate, tetrakis-[methylene-3-(3',5'-di-t-butyl-4'-hydroxy-phenyl)propionate]-methane, and 3,9-bis[2-[3-(3-t-butyl-4-hydroxy-5-methylphenyl)propionyloxy]-1,1-dimethylethyl]-2,4, 8,10-tetraoxaspiro[5,5]undecane. Examples of the hindered amine compounds include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxy phenyl)propionyloxy]ethyl-4-[3-(3,5-di-t-butyl-4-hydroxy phenyl)propionyloxy-2,2,6,6-tetramethylpiperidine, 8-benzyl-7,7,9,9-tetramethyl-3-octyl-1,3,8-triazaspiro[4,5]undecane-2,4-dion, 4-benzoylozy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl} {(2,2,6,6-tetramethyl-4-piperidyl)imino}hexamethylene {(2,3,6,6-tetramnethyl-4-piperidyl)imino}], 2-(3,5-di-t-butyl-4-hydroxybenzyl)-2-n-butylmalonic acid bis(1,2,2,6,6-pentamethyl-4-piperidyl), and N,N'-bis(3-amino propyl)ethylenediamine-2,4-bis[N-butyl-N-(1,2,2,6,6,-pentamethyl-4piperidyl)amino]-6-chloro-1,3,5-triazine condensate. Examples of the organic sulfur antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, 2-mercaptobenzimidazole.

Examples of the organophosphorus antioxidant include trisnonylphenyl phosphite, trisphenyl phosphite and tris(2,4-di-t-butylphenyl)-phosphite.

The organic sulfur antioxidant and the organophosphorus antioxidant are called second antioxidants, and a synergy effect can be obtained by using the second antioxidants with first antioxidants whose examples include phenol antioxidants and amine antioxidants.

Examples of the light stabilizers include benzophenone derivatives, benzotriazol derivatives, dithiocarbamate derivatives, and tetramethylpiperidine derivatives.

Examples of the benzophenone light stabilizers include 2-hydroxy-4-methoxybenzophenone, 2-hydroxy-4-octoxybenzophenone, 2,2'-di-hydroxy-4-methoxy benzophenone. Examples of the benzotriazol light stabilizers include 2-(-2'-hydroxy-5-2'methylphenyl-)-benzotriazole, 2-[2'-hydroxy-3'-(3",4",5",6"-tetra-hydrophthalimide-methyl)-5'-methylphenyl-benzot riazole, 2-(-2'-hydroxy-3'-t-butyl5'-methylphenyl-)-5-chlorobenzotriazole, 2-(2'-hydroxy-3'5'-t-butylphenyl-)-benzotriazole, 2-(2'-hydroxy-5'-t-octylphenyl)-benzotriazole, and 2-(2'-hydroxy3,5'-di-t-amylphenyl-)-benzotriazole.

Examples of the light stabilizers other than the stabilizers listed above include 2,4,di-t-butylphenyl3',5'-di-t-butyl-4'-hydroxybenzoate, and nickeldibutyl-dithiocarbamate.

At least one kind of electron-accepting substance can be included in the photoreceptor in order to improve the sensitivity or to decrease the residual potential and fatigue after repeated use. Examples of the electron accepting substance which can be included in the photoreceptor include succinic anhydride, maleic anhydride, dibromo maleic anhydride, phthalic anhydride, tetrabromo phthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, fluorenone-derivatives, quinone-derivatives, and benzene derivatives having electron attractive substituents such as Cl, CN and $NO_2$ are particularly preferable.

The charge transporting layer can contain fine particles made of silica and a fluororesin. The amount of the fluororesin contained in the charge transporting layer is within the range of 0.1 to 40% by mass relative to the total amount of the charge transporting layer, and more preferably within the range of 1 to 30% by mass. When the amount is 1% by mass or less, the reforming effect owing to dispersion of the fluororesin particles may be insufficient. On the other hand, when the amount is more than 40% by mass, the light transmittance decreases, and the residual potential also increases when used repeatedly in some cases.

It is preferable to select at least one resin from tetrafluoroethylene resins, trifluoroethylene resins, hexafluoropropylen resins, vinyl fluoride resins, vinylidene fluoride resins, difluorodiethylene chloride resins, and copolymers thereof as the fluororesin particles used for the photoreceptor of the invention. Tetrafluoroethylene resins and vinylidene fluoride resins are particularly preferable. Silicone oil in a small amount may be added to coating liquids as a leveling agent for improving the smoothness of the films.

The surface layer having high strength can be provided in order to make the surface layer resistant to wear-out, scars or the like. The high-strength surface layer may be a layer in which conductive fine particles are dispersed in a binder resin, a layer in which lubricant fine particles such as a fluororesin or an acrylic resin is dispersed in usual charge transporting layer materials, or a layer formed by using a hard coat agent such as silicone or an acrylate can be used. In view of strength, electric characteristics and stability of image quality or the like, the high-strength surface layer is preferably a layer made of a siloxane resin having charge transporting properties and a cross-linking structure, and more preferably a layer comprising a compound which has a structure represented by the following formula (1) because the layer is excellent in strength and stability. Examples of F in the formula (1), which is a structure having photocareer conveying properties, include a triarylamine compounds, benzidine compounds, arylalkan compounds, aryl-substituted ethylene compounds, stilbene compounds, anthracene compounds, hydrazone compounds, quinone compounds, fluorenone compounds, xanthone compounds, benzophenone compounds, cyanovinyl compounds, and ethylene compounds.

Formula (I)

G-D-F:

G: Inorganic hyaline network subgroup

D: Flexible organic subunit

F: Charge transporting subunit

G in the formula (1) cross-links with other G subunits to forms an inorganic hyaline network. G preferably comprises a group including reactive Si. And in that case, G forms three dimensional Si—O—Si bonds D in the formula (1) connects F that has charge transporting properties and the three dimensional inorganic hyaline network. D in the formula (1) provides a moderate flexibility to the stiff but fragile inorganic hyaline network so as to improve the strength of the film.

Only a single kind of compound represented by the formula (1) may be used or plural kinds of compounds represented by the formula (1) may be used simultaneously. At formation of the surface layer, at least one kind of compound having a group which can be bonded to the compound of the formula (1) is preferably added in order to further improve the mechanical strength of the cured film.

The group which can be bonded to the compound of the formula (1) mean the group which can be bonded to the silanol groups generated by the hydrolysis of the compound of the formula (1). Specific examples thereof include a group represented by $—Si(R_1)_{(3-a)}Q_a$, an epoxy group, an isocyanate group, a carboxyl group, a hydroxy group and a halogen. Among them, compounds having a group represented by $—Si(R_1)_{(3-a)}Q_a$, an epoxy group, or an isocyanate group are preferable because of their higher mechanical strength. Further, compounds having at least two such groups are more preferable because the cured films comprise three-dimensional cross-linking structures which render still higher mechanical strength.

Other coupling agents and fluorine compounds may be further added in order to adjust the film properties and the flexibility of the film. Various silane coupling agents and commercially-available silicone hard coating agents can be used as such compounds.

In this case, the silane coupling agent may be vinyltrichlorosilane, vinyltrimethoxysilane, vinyltriethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-amonopropylmethyldimethoxysilane, N-β-(amino ethyl)-γ-amonopropyltriethoxysilane, tetramethoxysilane, methyltrimethoxysilane, and dimethyldimethoxysilane or the like.

As the commercially produced silicone hard coating agents, KP-85, X-40-9740, and X-40-2239 (manufactured by the Shin-Etsu silicone Co., Ltd.); and AY42-440, AY42-441, and AY49-208 (manufactured by Dow Coming Toray Silicone Co., Ltd.) or the like can be used. Fluorine-containing compounds such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodesyltriethoxysilane, 1H,1H,2H,2H-perfluorooctyltriethoxysilane may be added so as to provide water repellency or the like.

Although the silane coupling agent can be used in an arbitrarily amount, the amount of the fluorine-containing compound is preferably no larger than 0.25 times as much as the amount of the silane coupling agents which do not contain any fluorine. If the amount of the fluorine-containing compound is above this range, a problem may be caused in the film properties of the cross-linked film.

In order to improve the strength of the film, it is more preferable to further use a compound which has a purality of substituted silicon group having a hydrolysable group represented by $—Si(R_1)_{(3-a)}Q_a$.

The coating liquids of layers may be prepared without addition of solvents. Solvents can be optionally used such as alcohols such as methanol, ethanol, propanol and butanol; ketones such as acetone and methyl ethyl ketone; and ethers such as tetrahydrofuran, diethylether and dioxane. However, boiling points thereof are preferably 100° C. or higher, and any mixture thereof can be used. Although the amount of the solvents can be arbitrarily set, the compound represented by the formula (1) is easily deposited when the amount of the solvents is too few. Therefore, the amount of the solvents may be within the range of 0.5 to 30 parts relative to 1 part of compounds represented by the formula (1), and preferably within the range of 1 to 20 parts relative to 1 part of compounds represented by the formula (1). The reaction temperature and the time depend on a type of the raw materials, and the reaction temperature is usually within the range of 0 to 100° C., preferably 10 to 70° C., and particularly preferably 150 to 50° C. Although the reaction time is not particularly limited, a gelation is likely to occur when the reactive time is longer. Therefore, the reaction time is preferably within the range of 10 minutes to 100 hours.

Examples of the curing catalyst include protonic acids such as hydrochloric acid, acetic acid, and phosphoric acid, sulfuric acid; bases such as ammonia, triethylamine; organotin compounds such as dibutyltin diacetate, and dibutyltin dioctoate; organic titanium compounds such as tetra-n-butyltitanate and tetraisopropyltitanate; organic aluminum compound such as aluminiumtributoxide and aluminiumtriacetylacetonate; iron salts of organic carboxylic acids; manganese salts; cobalt salts; zinc salts; and zirconium salts. Metal compounds are preferable in view of the preservation stability, and acetylacetonate or acetylacetonates of metals are more preferable. Aluminiumtriacetylacetonate is particularly preferable.

Although the amount of the curing catalyst to be used can be arbitrarily set, the amount is preferably within the range of 0.1 to 20% by mass, more preferably 0.3 to 10% by mass, based on the total amount of the materials which contain hydrolyzable silicon substituents in view of preservation stability, characteristics, and strength of the film or the like. Although the curing temperature can be arbitrarily set, the curing temperature is preferably 60° C. or higher, and more preferably 80° C. or higher so as to obtain desired strength.

Although the curing time can be arbitrarily set in accordance with necessity, the curing time is preferably within the range of 10 minutes to 5 hours. It is also effective to stabilize the characteristics of the film by leaving the film in a high humidity condition after the curing reaction. In addition, depending on uses, a surface treatment with hexamethyldisilazane and trimethylchlorosilane or the like may be conducted on the film to impart hydrophobicity to the surface.

An antioxidant is preferably included in the surface cross-linking cured film of the photoreceptor so as to prevent deterioration by an oxidizing gas such as ozone generated in a charger. When the life of the photoreceptor is elongated by improving its mechanical strength, the photoreceptor contacts with the oxidizing gas for a long time. Therefore, the photoreceptor has to have a stronger oxidation tolerance than short-life photoreceptors. The antioxidant is preferably a hindered phenolic antioxidant or a hindered amine antioxidant. Known antioxidants may be used such as an organic sulfur antioxidant, a phosphite antioxidant, a dithiocarbamic acid salt antioxidant, a thiourea antioxidant or a benzimidazole antioxidant. The amount of the antioxidant to be added is preferably 20% by mass or less, and more preferably 10% by mass or less.

Examples of the hindered phenolic antioxidant include 2,6-di-t-butyl-4-methylphenol, 2,5-di-t-butylhydroquinone,
N,N'-hexamethylenebis(3,5-di-t-butyl-4-hydroxyhydrocinnamide,
3,5-di-t-butyl-4-hydroxy-benzylphosphonate-diethylester,
2,4-bis[(octylthio)methyl-o-cresol, 2,6-di-t-butyl-4-ethylphenol,
2,2'-methylenebis(4-methyl-6-t-butylphenol),
2,2'-methylenebis(4-ethyl-6-t-butylphenol),
4,4'-butylidenebis(3-methyl-6-t-butylphenol), 2,5-di-t-amylhydroquinone,
2-t-butyl-6-(3-butyl-2-hydroxy-5-methylbenzyl)-4-methylphenylacrylate, and
4,4'-butylidenebis(3-methyl-6-t-butylphenol).

A resin soluble in alcohol can be added to the surface layer in order to improve its tolerance to electrical discharge gas, its machanical strength, its resistance to scars, dispersity of particles, to control its viscosity and wear, to decrease required driving torque, and to extend its pot life. Examples of the alcohol-soluble resin include a polyvinyl butyral resin, a polyvinyl formal resin, a polyvinyl acetal resin (for instance, S-LEC B, K or the like manufactured by Sekisui Chemical Co., Ltd.) such as a polyvinyl acetal resin whose butyral groups have been partially modified with formal or acetal, a polyamide resin, a cellulose resin, and a phenol resin. Particularly, polyvinyl acetal resins are preferable because of their excellent electric characteristic. The molecular weight of the resin is preferably within the range of 2000 to 100000, and more preferably within the range of 5000 to 50000. When the molecular weight is less than 2000, expected benefits of the resin are not obtained in some cases. When the molecular weight is more than 100000, the solubility of the resin decreases so that only a small amount of the resin can be added. Also, the resin with a too large molecular weight causes defective formation of the film at coating in some cases.

The amount of the resin to be added is preferably within the range of 1 to 40%, more preferably 1 to 30%, and most particularly 5 to 20%. When the amount is less than 1%, it may be difficult to achieve expected benefits of the resin, and when the amount is more than 40%, image blurs may be easily generated at high temperature and high humidity.

In addition, in order to prevent adhesion of dirts on the surface of the photoreceptor and to improve lubricity on the surface, various fine particles can be added to the surface layer. Only one kind of or plural kinds of fine particles may be used. An example of the fine particles is silicon-containing fine particles. The silicon-containing fine particles are fine particles containing silicon as a constitution element, and examples thereof include colloidal silica and silicone fine particles. The colloidal silica is selected from colloidal silicas with an average particle diameter of 1 to 100 nm and more preferably of 10 to 30 nm dispersed in an acid or an alkaline aqueous solution or an organic solvent such as an alcohol, a ketone or an ester. General commercially-available colloidal silicas can be used. Although the total solids content of the colloidal silica contained in the surface layer is not particularly limited, the content may be within the range of 1 to 50% by mass of the total solids content of the surface layer, and more preferably 0.1 to 30% by mass in order to obtain good film properties, good electric characteristics of the film, and high strength of the film.

The silicone fine particles used as the silicon-containing fine particles have a spherical shape, and have an average particle diameter of 1 to 500 nm, preferably 10 to 100 nm. The silicone fine particles are selected from the group consisting of siliconee resin particles, silicone rubber particle and silica particles which have been surface-treated with silicones. General commercially-available silicone fine particles can be used. Because the silicone fine particles having small diameters are chemically inactive and easily dispersed in resins and because the necessary content of the silicone fine particles for obtaining sufficient effect is low, the surface properties of the electrophotographic photoreceptor can be improved without obstructing the cross-linking reaction. When the silicone fine particles are included in the surface layer having the cross-linking structure, the silicone fine particles improve the lubricity and water-shedding quality on the surface of the electrophotographic photoreceptor; thus the surface layer including the silicone fine particles can maintain excellent abrasion resistance and resistance to dirt adhesion for a long time. The content of the silicone fine particles contained in the surface layer may be within the range of 0.1 to 30% by mass of the total solids content of the surface layer, and more preferably 0.5 to 10% by mass.

Examples of the fine particles other than the silicon-containing fine particles include: fluorine-containing fine particles such as tetrafluoroethylene fine particles, trifluoroethylene fine particles, hexafluoroethylene fine particles, vinyl fluoride fine particles and vinylidene fluoride fine particles; fine particles made of a resins obtained by copolymerizing monomers of the above fluorocarbon resins and monomers having hydroxyl groups (whose examples are shown in "the 8th polymer material forum lecture abstract" p. 89; and semiconductive metal oxides such as ZnO—$Al_2O_3$, $SnO_2$—$Sb_2O_3$, $In_2O_3$—$SnO_2$, ZnO—$TiO_2$, ZnO—$TiO_2$, MgO—$Al_2O_3$, FeO—$TiO_2$, $TiO_2$, $SnO_2$, $In_2O_3$, ZnO, and MgO.

Oils such as silicone oils can be added for similar purpose to the purpose of adding the fine particles. Examples of the silicone oils include silicone oils such as dimethylpolysiloxane, diphenylpolysiloxane and phenylmethylsiloxane; reactive silicone oils such as an amino-modified polysiloxane, an epoxy-modified polysiloxane, a carboxyl-modified polysiloxane, a carbinol-modified polysiloxane, a methacryl-modified polysiloxane, a mercapto-modified polysiloxane, and a phenol-modified polysiloxane; cyclic dimethylcyclosiloxanes such as hexamethylcyclotrisiloxane, octamethylcyclotetrasiloxane, decamethylcyclopentasiloxane, dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; methylhydroxysiloxane mixture; hydrosilyl group-cntaining cyclosiloxanes such as pentamethylcyclopentasiloxane and phenylhydrocyclosiloxane; and cyclic siloxanes such as vinyl group-containing cyclosiloxanes such as pentavinylpentamethylcyclopentasiloxane.

The siloxane resins, which have charge transporting properties and cross-linking structures, have excellent machanical strength and sufficient photoelectric characteristics. Therefore, the siloxane resins themselves can be used as the charge transporting layer of a lamination-type photoreceptor. In this case, usual methods such as a blade coating method, a meyer bar coating method, a spray coating method, a dip coating method, a bead coating method, an air knife coating method, and a curtain coating method can be used. When a necessary film thickness is not obtained by a single coating, the siloxane resins may be applied several times to obtain a necessary film thickness. When the siloxane resins are applied more than once, a heat treatment may be conducted every time, or may be conducted once per several coating processes.

A single-layer type photosensitive layer is used, the layer comprise the electric charge generating substance and a binder resin. The binder resin may be selected from the binder resins usable for the electric charge generating layer and the charge transporting layer. The content of the electric charge generating substance in the single-layer type photosensitive layer is within the range of about 10 to about 85% by mass, and more preferably 20 to 50% by mass. A charge transporting substance or a polymer charge transporting substance may be added to the single-layer type photosensitive layer for the purpose of improving the photoelectric characteristic of the layer or the like. The amount of the charge transporting substance and the polymer charge transporting substance is preferably within the range of 5 to 50% by mass. The compound represented by the formula (1) may be added. The solvent and the coating method used for applying the layer can be selected from the solvents and the coating methods described above. The film thickness is preferably within the range of about 5 to about 50 μm, and more preferably within the range of 10 to 40 μm.

In addition, the surface layer of the photoreceptor can be coated with an aqueous dispersion of a modified resin containing a fluororesin as a main component, by usual coating methods including dip coating methods. By this treatment, required driving torque can be further reduced, and efficiency in toner transfer can be improved.

The aqueous dispersion of a modified resin containing a fluororesin will be described.

Examples of the fluororesins include a homopolymer of tetrafluoroethylene; a copolymer including tetrafluoroethylene such as a copolymer of tetrafluoroethylene and olefine, a copolymer of tetrafluoroethylene and fluorine-containing olefine, a copolymer of tetrafluoroethylene and perfluoro olefine, and a copolymer of tetrafluoroethylene and fluoroalkylvinylether; a homopolymer of vinylidene fluoride; a copolymer including vinylidene fluoride such as a copolymer of vinylidene fluoride and olefine, a copolymer of vinylidene fluoride and fluorine-containing olefine, a copolymer of vinylidene fluoride and perfluoro olefine, and a copolymer of vinylidene fluoride and fluoroalkylvinylether; a homopolymer of chlorotrifluoroethylene; and a copolymer including chlorotrifluoroethylene such as a copolymer of chlorotrifluoroethylene and olefine, a copolymer of chlorotrifluoroethylene and fluorine-containing olefine, a copolymer of chlorotrifluoroethylene and perfluoro olefine, and a copolymer of chlorotrifluoroethylene and fluoroalkylvinyletheror. Particularly, a homopolymer of tetrafluoroethylene or a copolymer including tetrafluoroehylene is preferable. A mixture of a homopolymer of tetrafluoroethylene and various copolymers is preferably used at a mixing ratio by mass of 95:5 to 10:90 (homopolymer of tetrafluoroethylene: copolymers).

The aqueous dispersion of the modified resin containing a fluororesin may further include a wax and/or a silicone. The wax and/or the silicone facilitate penetration of the fluororesin into the interior of the blade. Examples of the wax include a paraffin wax, a microcrystalline wax, and petrolatum, and examples of the silicone include a silicone oil, a silicone grease, an oil compound, and a silicone varnish.

A fluorine, nonion, cation, anion or ampholytic surfactants, a pH adjuster, a solvent, a polyhydric alcohol, a softening agent, a viscosity adjuster, an light stabilizer and an antioxidant or the like can be mixed with the aqueous dispersion of a modified resin containing a fluororesin as main a component.

The layer (a penetrative layer) composed of the aqueous dispersion of a modified resin containing a fluororesin is prepared by immersing the photoreceptor in the aqueous dispersion. The penetrative layer can be formed under reduced pressure for promoting the penetration of the fluororesin. In this case, pressure is preferably 0.9 atmospheric pressure or lower, more preferably 0.8 atmospheric pressure or lower, and more preferably 0.7 atmospheric pressure or lower. It is effective in promoting the penetration to heat the aqueous dispersion to 40° C. or higher, more preferably at 50° C. or higher. The pressure is preferably 0.1 atmospheric pressure or higher, more preferably 0.2 atmospheric pressure or higher, and more preferably 0.3 atmospheric pressure or higher. It is also effective to combine processes selected from a pressure reduction process, a pressure increase process, and a heating process. The penetrative layer can be provided also by: applying the aqueous dispersion to the surface of the photoreceptor by a spray method or a coating method; and heated the wet film to 40° C. or higher, more preferably at 50° C. or higher. Wiping off or rinsing can be conducted during a period between the application of the aqueous dispersion of the modified resin and the heating, or a period after the heating.

<Charging Device>

Known charging methods can be applied to the image forming apparatus of the invention, and examples thereof include a corotron charging method and a contact charging method. The contact charging method may include use of a roller charging member, a blade charging member, and a belt charging member, a brush charging member, or a magnetic brush charging member. The roller charging member and the blade charging member may be so arranged that the photoreceptor contacts with the charging member or so that there is a space (100 μm or less) between the photoreceptor and the charging member.

The roller charging member, the blade charging member, and the belt charging member are preferably composed of materials having electrical resistances ($10^3$ Ω–$10^8$ Ω) suitable for charging members, and may comprise only a single layer or a plurality of layers. The main components of the charging members may be selected from synthetic rubbers such as urethane rubbers, silicone rubbers, fluorine rubbers, chloroprene rubbers, butadiene rubbers, EPDM, and epichlorohydrin rubbers, and elastomers made of polyolefins, polystyrenes, vinyl chloride or the like. Proper amounts of arbitrary conductivity imparting agents such as conductive carbons, metal oxides and ion conductive agents are mixed with the above main components to impart an electric conductivity suitable for charging members. In addition, the charging member may be coated with a coating liquid prepared by providing a coating liquid including a resin such as nylon, a polyester, a polystyrene, a polyurethane or a silicone and mixing the coating liquid and an arbitrary conductivity imparting agent such as a conductive carbon, a metal oxide or an ion conductive agent in a proper amount. The coating method may be a dipping method, a spray method, a roll coat method or the like.

<Exposing Device>

Known exposing methods can be applied to the image forming apparatus of the invention. For instance, the exposure may be conducted by an electrophotographic method in which light information corresponding to image information is used and an electrostatic latent image carrier is exposed based on an image density gradation according to an area modulation method, to form a latent image.

<Transfer Device>

Known transfer methods can be applied to the image forming apparatus of the invention. Examples thereof include a direct transfer method in which a transfer corotron, a transfer roll or the like are used to directly transfer the image onto a recording material; an intermediate transfer method in which an intermediate transfer body such as an intermediate transfer belt or an intermediate transfer drum is used; and a transfer belt method in which a recording material is electrostatically attracted and carried, and the image formed on the image carrier is transferred onto the recording material.

When the image forming apparatus of the invention is used as a color image forming apparatus, the image forming apparatus can adopt a single method in which a plurality of developers are arranged around the image carrier, or a tandem method in which a plurality of image carriers and the developer are arranged.

The process cartridge of the invention has at least the photoreceptor and the cleaning device for removing toner remaining on the surface of the photoreceptor after the transfer of toner image. The process cartridge can be attached to and detached from the image forming apparatus. Its cleaning device is similar to the cleaning device in the image forming apparatus of the invention described above, and the same effect as the image forming apparatus of the invention can be achieved by using the process cartridge of the invention.

EXAMPLES

Examples 1 to 5, Comparative Examples 1 to 3

Polymerization toners described in Table 1 is used in an experiment apparatus (a modified appratus of trade name; DOCUPRINT C830 manufactured by Fuji Xerox Co., Ltd.) having the cleaning device according to the first embodiment of the image forming apparatus of the invention described above. A full-color-image formation running test of 200,000 sheets is respectively conducted (in total 40,000 sheets) at high temperature and high humidity (28° C., 80% RH) and at low temperature and low humidity (10° C., 20%RH). Toner cleaning performance, blade edge damages, fluttering sound of a blade, and abrasion amount of the photoreceptor are evaluated. The image used in the running test comprises a portion (low image-density portion) where the average image density is low and a portion (high image-density portion) where the average image density is high, which are longitudinally separated from each other. The evaluation of the cleaning performance is conducted on both portions.

The toner accumulating member 31 has a constitution shown in FIG. 2 (a front view of the accumulating sheet: FIG. 3), and the lower sheet 30 is made of a polyurethane resin having a thickness of 20 μm. In the toner accumulating member 31, the part (upper part) having a higher flexibility is made of a polyethylene terephthalate (PET) resin having a thickness of 50 μm, and the part (lower part) having a lower flexibility is made of a polyethylene terephthalate (PET) resin having a thickness of 500 μm. (However, the part (lower part) having a low flexibility is composed of an aluminum plate having a thickness of 1 mm in Example 2).

The cleaning device is described in detail in Table 1.

The toner accumulating member 31 of Comparative Example 1 does not have the opening 34. The toner accumulating member 31 is not provided in Comparative Example 3.

The toners used in Example 4, and Examples 6 and 7 described below are obtained by adding 0.2 parts by mass of zinc stearate (trade name; ZNS-P, manufactured by Asahi Denka Kogyo K.K.) to 100 parts by mass of a toner for DOCUCENTRE COLOR 400CP. The toner for DOCUCENTRE COLOR 400 CP is manufactured by Fuji Xerox Co., Ltd. On the other hand, the toner used in Example 5 is obtained by adding 0.5 part by mass of a higher alcohol (trade name; UNILIN700, manufactured by TOYO-Petrolite) to 100 parts by mass of the toner for DOCUCENTRE COLOR 400CP.

TABLE 1

| | S(O) $mm^2$ | S(C) $mm^2$ | S(O)/S(C) (%) | H(O) mm | H(C) mm | H(O)/H(C) (%) | H(M) mm | L(C) mm | L(O) mm | L(G) mm | n | Toner |
|---|---|---|---|---|---|---|---|---|---|---|---|---|
| Example 1 | 423.4 | 2945 | 14.38 | 2 | 9.5 | 21.1 | 3 | 310 | 228 | 82 | 38 | Toner for DOCUCENTRE COLOR 400CP |
| Example 2 | 423.4 | 2945 | 14.38 | 2 | 9.5 | 21.1 | 3 | 310 | 228 | 82 | 38 | Toner for DOCUCENTRE COLOR 400CP |
| Example 3 | 615.1 | 2945 | 20.89 | 2 | 9.5 | 21.1 | 3 | 310 | 306 | 0 | 1 | Toner for DOCUCENTRE COLOR 400CP |
| Example 4 | 423.4 | 2945 | 14.38 | 2 | 9.5 | 21.1 | 3 | 310 | 228 | 82 | 38 | Toner for DOCUCENTRE COLOR 400CP + zinc stearate |
| Example 5 | 423.4 | 2945 | 14.38 | 2 | 9.5 | 21.1 | 3 | 310 | 228 | 82 | 38 | Toner for DOCUCENTRE COLOR 400CP + higher alcohol fine powder |
| Comparative Example 1 | 0 | 2945 | 0 | 0 | 9.5 | 0 | 3 | 310 | 0 | 82 | 0 | Toner for DOCUCENTRE COLOR 400CP |
| Comparative Example 2 | 1639.4 | 2945 | 55.66 | 6 | 9.5 | 63.2 | 3 | 310 | 228 | 82 | 38 | Toner for DOCUCENTRE COLOR 400CP |
| Comparative Example 3 | — | — | — | — | — | — | — | — | — | — | — | Toner for DOCUCENTRE COLOR 400CP |

Examples 6, 7

Polymerization toners described in Table 2 is used in an experiment apparatus (a modified appratus of trade name; DOCUPRINT C830 manufactured by Fuji Xerox Co., Ltd.) having the cleaning device according to the second embodiment of the image forming apparatus of the invention described above. A full-color-image formation running test of 200,000 sheets is respectively conducted (in total 40,000 sheets) at high temperature and high humidity (28° C., 80% RH) and at low temperature and low humidity (10° C., 20%RH). Toner cleaning performance, blade edge damages, fluttering sound of a blade, and abrasion amount of the photoreceptor are evaluated. The image used in the running test comprises a portion (low image-density portion) where the average image density is low and a portion (high image-density portion) where the average image density is high, which are longitudinally separated from each other. The evaluation of the cleaning performance is conducted on both portions.

A first toner accumulating member 31' and a second toner accumulating member 32' have the constitution shown in FIG. 6 (a front view of an accumulating sheet: FIG. 7), and the lower sheet 30 is made of a polyurethane resin having a thickness of 20 μm. In the first toner accumulating member 31', the part having a high flexibility is made of the polyethylene terephthalate (PET) resin having a thickness of 50 μm, and the part having a low flexibility is made of a polyethylene terephthalate (PET) resin having a thickness of 500 μm. The second toner accumulating member 32' is composed of an aluminum plate having a thickness of 1 mm. As in FIG. 6, in FIG. 7, numeral 31' designates the first toner accumulating member, and numeral 32' designates the second toner accumulating member. Numerals 34', 35' designate openings, and numeral 37 designates a housing. The cleaning device are described in detail in Table 2.

TABLE 2

| | S(O1) $mm^2$ | S(O2) $mm^2$ | S(C) $mm^2$ | S(O2)/S(C) (%) | H(O1) mm | H(O2) mm | H(H1) mm | H(H2) mm | H(B) mm | H(M) mm | L(C1) mm | L(O1) mm | L(G1) mm | n | Toner |
|---|---|---|---|---|---|---|---|---|---|---|---|---|---|---|---|
| Example 6 | 423.4 | 144 | 2945 | 4.89 | 2 | 1.5 | 10.5 | 3 | 9.5 | 3 | 310 | 228 | 82 | 38 | Toner for DOCUCENTRE COLOR 400CP + zinc stearate |
| Example 7 | 615.1 | 144 | 2945 | 4.89 | 2 | 1.5 | 10.5 | 3 | 9.5 | 3 | 310 | 306 | 0 | 1 | Toner for DOCUCENTRE COLOR 400CP + zinc stearate |

<Evaluation>

The following evaluations are executed. Table 3 shows the results.

(Cleaning Performance (Low Image Density))

The cleaning performance (low image density) evaluates cleaning deterioration caused by blade damages. The cleaning performance of the blade is evaluated in a stress condition, and the blade edge damages (the abrasion amount of an edge tip part) are measured by a laser microscope (manufactured by KEYENCE Corporation). The evaluation criteria is as follows.

A: There are no problems in cleaning performance, and the abrasion amount of the edge is nothing.

B: There are no problems in cleaning performance, and the abrasion amount of the edge is small.

C: There are no problems in cleaning performance, however the abrasion amount of the edge is large.

D: A cleaning defect occurs.

(Cleaning Performance (High Image Density))

The cleaning performance (high image density) evaluates the cleaning performance deterioration caused by an excessive pressure of toner, and the cleaning performance of the blade is evaluated in a stress condition. The criteria is as follows.

A: There are no problems in cleaning performance, and the abrasion amount of the edge is nothing.

B: There are no problems in cleaning performance.

C: There are no problems in cleaning performance, however the abrasion amount of the edge is large.

D: A cleaning defect occurs.

Fluttering Sound of a Blade

The fluttering sound of the blade is evaluated by functional evaluation of the running sound at high temperature and high humidity.

A: The fluttering sound is not audible at all.

B: The fluttering sound is hardly audible.

C: The fluttering sound is slightly audible.

D: The fluttering sound is clearly audible.

(Abrasion Amount of a Photoreceptor)

The abrasion amount of the photoreceptor is determined by determining the decrease in the thickness of the photoreceptor measured by an eddy-current type film-thickness meter. In addition to evaluating the difference in the film thickness between before and after the 40,000 sheets running test according to the conventional criteria, the difference in the film thickness between before and after a 120,000 sheets running test is also evaluated as a criteria for the judgement of the long term maintainability.

After 40,000 Sheets Running Test

A: The average abrasion amount is 4 μm or less, and no local abrasion of 4 μm or more is found.

B: The average abrasion amount is 4 μm or less, and a local abrasion of 4 μm or more is found.

C: The average abrasion amount is 4 μm or more.

After 120,000 Sheets Running Test

A: The average abrasion amount is 12 μm or less, and no local abrasion of 12 μm or more is found.

B: The average abrasion amount is 12 μm or less, and the local abrasion of 12 μm or more is found.

C: The average abrasion amount is 12 μm or more.

TABLE 3

| | Cleaning performance | | Fluttering sound of a | Abrasion amount of a photoreceptor | | |
|---|---|---|---|---|---|---|
| | Low image density | High image density | blade | After 40,000 sheets | After 120,000 sheets | Overall judgement |
| Example 1 | B | B | B | A | A | B |
| Example 2 | B | B | B | A | A | B |
| Example 3 | B | B | B | A | A | B |
| Example 4 | B | B | A | A | A | A |
| Example 5 | B | B | A | A | A | A |
| Example 6 | A | A | A | A | A | A |
| Example 7 | A | A | A | A | A | A |
| Comparative Example 1 | B | B | B | B | B | C |
| Comparative Example 2 | B | B | B | C | — | D |
| Comparative Example 3 | D | B | D | C | — | D |

Table 3 shows that the image forming apparatuses having the cleaning device in Examples 1 to 7 give a satisfactory result.

The invention can provide an image forming apparatus and a process cartridge both of which can prevent defective cleaning even when a spherical toner is used and can prevent damages such as the fluttering sound of the cleaning blade, an inversion of the blade, a nick of the cleaning edge and an abrasion of the cleaning edge.

What is claimed is:

1. An image forming apparatus comprising: a photoreceptor; a charging device which charges a surface of the photoreceptor; an exposing device which exposes the surface of the photoreceptor to form a latent image; a developing device which adheres a toner to the latent image to form a toner image on the surface of the photoreceptor; a transferring device which transfers the toner image to a transfer medium; and a cleaning device which removes a toner remaining on the surface of the photoreceptor after the toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; and a toner accumulating member which is disposed nearer to the housing than the cleaning blade and the lower seal are, wherein a lower end of the toner accumulating member is fixed; an upper end of the toner accumulating member is located above a lower end of the cleaning blade; the toner accumulating member accumulates the toner at a tip of the cleaning blade; the toner accumulating member has at least one opening; and the following condition is satisfied:

$$0\% < S(O)/S(C) \leqq 50\%$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

2. The image forming apparatus according to claim 1, wherein a distance H(O) between the lower end of the toner accumulating member and an upper end of the opening(s), and a distance H(C) between the lower end of the toner accumulating member and the position which is same height as the lower end of the cleaning blade satisfy the following conditions:

$$0\% < H(O)/H(C) \leqq 50\%, \text{ and } H(C) - H(O) \geqq 4 \text{ mm.}$$

3. The image forming apparatus according to claim 1, wherein a length L(C) of the toner accumulating member in its longitudinal direction, a total sum L(O) of lengths of the opening(s) in the longitudinal direction wherein a total number of the opening(s) is designated by n, and a total sum L(G) of distances in the longitudinal direction between the adjacent openings satisfy the following condition:

$$50\% \leqq L(O)/L(C) < 100\%,\ L(G) \leqq L(O), \text{ and } 10 \leqq L(C)/(L(O)/n).$$

4. The image forming apparatus according to claim 1, wherein a distance H(O) between the lower end of the toner accumulating member and an upper end of the opening(s), a distance H(C) between the lower end of the toner accumulating member and the position which is same height as the lower end of the cleaning blade, and L(O)/n satisfy the following condition:

$$H(C) - H(O) \geqq L(O)/n$$

wherein L(O) represents a total sum of lengths of the opening(s) in the longitudinal direction and a total number of the opening(s) is designated by n.

5. The image forming apparatus according to claim 1, wherein the following condition is satisfied:

$$10\% \leqq S(O)/S(C) \leqq 50\%,$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

6. The image forming apparatus according to claim 1, wherein the following condition is satisfied:

$$14\% \leqq S(O)/S(C) \leqq 30\%,$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

7. An image forming apparatus comprising: a photoreceptor; a charging device which charges a surface of the photoreceptor; an exposing device which exposes the surface of the photoreceptor to form a latent image; a developing device which adheres a toner to the latent image to form a toner image on the surface of the photoreceptor; a transferring device which transfers the toner image to a transfer medium; and a cleaning device which removes a toner remaining on the surface of the photoreceptor after the toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; a first toner accumulating member; and a second toner accumulating member, wherein the first and second toner accumulating members are disposed nearer to the housing than the cleaning blade and the lower seal are; a lower end of the second toner accumulating member is fixed; a lower end of the first toner accumulating member is fixed by the lower seal and/or the housing; an upper end of the first toner accumulating member is located above a lower end of the cleaning blade; the first and second toner accumulating members accumulate the toner at a tip of the cleaning blade; the second toner accumulating member is more flexible than the first toner accumulating member; and the first toner accumulating member has at least one opening which is near to a portion fixed by the lower seal and/or the housing.

8. The image forming apparatus according to claim 7, wherein a distance H(H1) between the lower end of the first toner accumulating member and an upper end thereof, a distance H(O1) between the lower end of the first toner accumulating member and an upper end of the opening(s), a distance H(H2) between the lower end of the second toner accumulating member and an upper end thereof, and a distance H(B) between the lower end of the first toner accumulating member and a position thereon at the same height as a lower end of the cleaning blade satisfy the following condition:

$$H(H1) \geqq H(H2) \geqq H(O1), \text{ and } H(B) - H(O1) \geqq 4 \text{ mm.}$$

9. A process cartridge comprising a cleaning device which removes a toner remaining on a surface of a photoreceptor after a toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; and a toner accumulating member which is disposed nearer to the housing than the cleaning blade and the lower seal are, wherein the process cartridge can be attached to and detached from an image forming apparatus; a lower end of the toner accumulating member is fixed; an upper end of the toner accumulating member is located above a lower end of the cleaning blade; the toner accumulating member accumulates the toner at a tip of the cleaning blade; the toner accumulating member has at least one opening; and the following condition is satisfied:

$$0\% < S(O)/S(C) \leqq 50\%$$

wherein S(O) is a total opening area obtained by summing areas of all openings; and S(C) is an area of a rectangle defined by two sides having the same length as a length of the cleaning blade in its longitudinal direction and two sides having the same length as a distance between the lower end of the toner accumulating member and a position at the same height on the toner accumulating member as the lower end of the cleaning blade.

10. The process cartridge according to claim 9, wherein a distance H(O) between the lower end of the toner accumulating member and an upper end of the opening(s), and a distance H(C) between the lower end of the toner accumulating member and the position which is same height as the lower end of the cleaning blade satisfy the following condition:

$$0\% < H(O)/H(C) \leqq 50\%, \text{ and } H(C) - H(O) \geqq 4 \text{ mm}.$$

11. The process cartridge according to claim 9, wherein a length L(C) of the toner accumulating member in its longitudinal direction, a total sum L(O) of lengths of the opening(s) in the longitudinal direction wherein a total number of the opening(s) is designated by n, and a total sum L(G) of distances in the longitudinal direction between the adjacent openings satisfy the following condition:

$$50\% \leqq L(O)/L(C) < 100\%,\ L(G) \leqq L(O), \text{ and } 10 \leqq L(C)/(L(O)/n).$$

12. The process cartridge according to claim 9, wherein a distance H(O) between the lower end of the toner accumulating member and an upper end of the opening(s), a distance H(C) between the lower end of the toner accumulating member and the position which is same height as the lower end of the cleaning blade, and L(O)/n satisfy the following condition:

$$H(C) - H(O) \geqq L(O)/n$$

wherein L(O) represents a total sum of lengths of the opening(s) in the longitudinal direction and a total number of the opening(s) is designated by n.

13. A process cartridge comprising a cleaning device which removes a toner remaining on a surface of a photoreceptor after a toner image is transferred, the cleaning device including a cleaning auxiliary device comprising: a cleaning blade which scrapes the toner from the surface of the photoreceptor; a housing which stores the toner scraped from the surface of the photoreceptor; a lower seal which receives the toner and guides the toner to the housing; a first toner accumulating member; and a second toner accumulating member, wherein the first and second toner accumulating members are disposed nearer to the housing than the cleaning blade and the lower seal are; a lower end of the second toner accumulating member is fixed; a lower end of the first toner accumulating member is fixed by the lower seal and/or the housing; an upper end of the first toner accumulating member is located above a lower end of the cleaning blade; the first and second toner accumulating members accumulate the toner at a tip of the cleaning blade; the second toner accumulating member is more flexible than the first toner accumulating member; and the first toner accumulating member has at least one opening which is near to a portion fixed by the lower seal and/or the housing.

14. The process cartridge according to claim 13, wherein a distance H(H1) between the lower end of the first toner accumulating member and an upper end thereof, a distance H(O1) between the lower end of the first toner accumulating member and an upper end of the opening(s), a distance H(H2) between the lower end of the second toner accumulating member and an upper end thereof, and a distance H(B) between the lower end of the first toner accumulating member and a position thereon at the same height as a lower end of the cleaning blade satisfy the following condition:

$$H(H1) \geqq H(H2) \geqq H(O1), \text{ and } H(B) - H(O1) \geqq 4 \text{ mm}.$$

* * * * *